US010784595B2

(12) United States Patent
Tyler

(10) Patent No.: US 10,784,595 B2
(45) Date of Patent: Sep. 22, 2020

(54) POWER TERMINAL FOR AN ELECTRICAL CONNECTOR

(71) Applicant: TE CONNECTIVITY CORPORATION, Berwyn, PA (US)

(72) Inventor: Adam Price Tyler, Rochester Hills, MI (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 349 days.

(21) Appl. No.: 15/661,802

(22) Filed: Jul. 27, 2017

(65) Prior Publication Data

US 2018/0034171 A1 Feb. 1, 2018

Related U.S. Application Data

(60) Provisional application No. 62/369,418, filed on Aug. 1, 2016.

(51) Int. Cl.
*H01R 4/48* (2006.01)
*H01R 13/11* (2006.01)
(Continued)

(52) U.S. Cl.
CPC ..... *H01R 4/48* (2013.01); *H01R 4/023* (2013.01); *H01R 4/184* (2013.01); *H01R 13/112* (2013.01);
(Continued)

(58) Field of Classification Search
CPC ..... H01R 4/48; H01R 4/023; H01R 4/184; H01R 13/18; H01R 13/187; H01R 13/113
(Continued)

(56) References Cited

U.S. PATENT DOCUMENTS 6,139,351 A * 10/2000 Schaefer ..... B60L 3/0069 439/372
7,150,660 B2 * 12/2006 Allgood ..... H01R 11/289 439/845
(Continued)

FOREIGN PATENT DOCUMENTS

EP 1730818 10/2008
EP 2652841 A1 10/2013
(Continued)

OTHER PUBLICATIONS

International Search Report, International Application No. PCT/IB2017/054625, International Filing Date Jul. 28, 2017.
(Continued)

*Primary Examiner* — Nguyen Tran
*Assistant Examiner* — Paul D Baillargeon

(57) ABSTRACT

A power terminal includes a terminal body having a mating portion including plates with a mating space therebetween. A spring clip is coupled to the mating portion and includes inner spring plates extending along the plates in the mating space with a slot therebetween. The inner spring plates directly engage and electrically connect to the terminal body and to a tab terminal received in the slot. The spring clip includes at least one cantilevered contact spring configured to be spring biased against and electrically connected to the tab terminal. The spring clip includes at least one stabilization contact spring spring biased against and electrically connected to the corresponding plate and configured to be spring biased against and electrically connected to the tab terminal. The stabilization contact spring provides a greater contact normal force against the tab terminal than the cantilevered contact spring.

22 Claims, 12 Drawing Sheets

(51) Int. Cl.

| | |
|---|---|
| ***H01R 13/187*** | (2006.01) |
| ***H01R 4/02*** | (2006.01) |
| ***H01R 4/18*** | (2006.01) |
| ***H01R 13/629*** | (2006.01) |
| ***H01R 13/64*** | (2006.01) |
| ***H01R 13/71*** | (2006.01) |
| ***H01R 24/76*** | (2011.01) |
| *H01R 101/00* | (2006.01) |
| *H01R 13/18* | (2006.01) |
| *H01R 107/00* | (2006.01) |

(52) U.S. Cl.
CPC ..... *H01R 13/113* (2013.01); *H01R 13/187* (2013.01); *H01R 13/62938* (2013.01); *H01R 13/62977* (2013.01); *H01R 13/64* (2013.01); *H01R 13/71* (2013.01); *H01R 24/76* (2013.01); *H01R 13/18* (2013.01); *H01R 2101/00* (2013.01); *H01R 2107/00* (2013.01); *H01R 2201/26* (2013.01)

(58) Field of Classification Search
USPC ..... 439/817, 834, 842, 843, 845, 852, 856, 439/857, 224
See application file for complete search history.

(56) References Cited

U.S. PATENT DOCUMENTS

| | | | | |
|---|---|---|---|---|
| 7,241,189 | B2 | 7/2007 | Mohs et al. | |
| 8,419,486 | B2 | 4/2013 | Tyler | |
| 2002/0193019 | A1 | 12/2002 | Blanchfield et al. | |
| 2008/0318460 | A1 | 12/2008 | Hsieh et al. | |
| 2012/0315806 | A1 | 12/2012 | Myer et al. | |
| 2016/0285187 | A1* | 9/2016 | Oba | H01R 4/023 |
| 2017/0324183 | A1* | 11/2017 | Marsh | H01R 13/426 |

FOREIGN PATENT DOCUMENTS

| | | | | |
|---|---|---|---|---|
| WO | 2011067632 | A1 | 6/2011 | |
| WO | WO-2013153089 | A1 * | 10/2013 | H01R 13/113 |

OTHER PUBLICATIONS

Japanese Search Report from First Office Action, Japanese Application No. 2019-504893 dated Mar. 17, 2020.

* cited by examiner

POWER TERMINAL FOR AN ELECTRICAL CONNECTOR

CROSS-REFERENCE TO RELATED APPLICATIONS

This application claims the benefit of U.S. Provisional Application No. 62/369,418, filed Aug. 1, 2016, titled "POWER TERMINAL FOR AN ELECTRICAL CONNECTOR", the subject matter of which is herein incorporated by reference in its entirety.

BACKGROUND OF THE INVENTION

The subject matter herein relates generally to power terminals for electrical connectors.

Power terminals are used to make a power connection between components in high power applications, such as in electric or hybrid electric vehicles between the battery and other components, such as the motor. Often, in such applications, the system includes a high voltage interlock (HVIL) circuit to power down the high power circuit prior to unmating of the power terminals. However, electrical connectors housing the power terminals are not without disadvantages. For instance, some electrical connectors have insufficient overtravel for the power terminals for adequate staggered separation of the HVIL circuit and the high voltage circuit within the same connector. As such, a separate HVIL connector is provided that is unmated prior to unmating the high voltage connector. Such arrangements add cost and complexity to the system. Furthermore, the power terminals, particularly in automotive applications, are subjected to vibration and wear over time. The spring beams making the electrical connection between the power terminals may degrade over time reducing stability of the system. Using higher normal force spring beams to compensate for such stability problems leads to wear of the plating at the mating interface over time.

Furthermore, there are many different arrangements for the electrical connectors, such as depending on the particular vehicle or application. For example, different vehicles may require different placement of one or both of the electrical connectors, leading to many different types of electrical connectors for the automotive manufacturers. For example, some manufacturers may require both 90° and 180° applications to accommodate different connector arrangements. Some manufacturers may require a weld tab termination or a crimped wire termination. Tooling an entirely different terminal design for each potential application is expensive. Additionally, maintaining a large part supply for each manufacturer is expensive.

A need remains for an electrical connector system having power terminals that are reliable and cost effective.

BRIEF DESCRIPTION OF THE INVENTION

In one embodiment, a power terminal for a high power electrical connector is provided that includes a terminal body having a terminating portion, a mating portion and a base between the terminating portion and the mating portion. The terminating portion is configured to be terminated to a power wire. The mating portion has first and second plates with a mating space therebetween. A spring clip is coupled to the mating portion of the terminal body. The spring clip has an outer shell extending along an exterior of the first and second plates and first and second inner spring plates extending along the first and second plates, respectively, in the mating space. A slot is defined between the first and second inner spring plates configured to receive a tab terminal. The first and second inner spring plates are configured to directly engage and electrically connect the mating portion of the terminal body and the tab terminal. The spring clip includes at least one cantilevered contact spring configured to be spring biased against and electrically connected to the tab terminal. The spring clip includes at least one stabilization contact spring spring biased against and electrically connected to at least one of the first plate or the second plate and configured to be spring biased against and electrically connected to the tab terminal. The stabilization contact spring provides a greater contact normal force against the tab terminal than the cantilevered contact spring.

In another embodiment, an electrical connector is provided for mating with and unmating from a high power header connector having a header tab terminal and a high voltage interlock (HVIL) contact. The electrical connector includes a housing having a terminal chamber and an HVIL terminal chamber. A HVIL terminal is received in the terminal chamber. The HVIL terminal has a mating interface configured to be mated to and unmated from the HVIL contact to control a high voltage circuit of the electrical connector. A power terminal is received in the terminal chamber and is configured for electrical connection with the header tab terminal when the electrical connector is mated with the header connector. The power terminal includes a terminal body having a terminating portion, a mating portion and a base between the terminating portion and the mating portion. The terminating portion is configured to be terminated to a power wire. The mating portion has first and second plates with a mating space therebetween. A spring clip is coupled to the mating portion of the terminal body. The spring clip has an outer shell extending along an exterior of the first and second plates and first and second inner spring plates extending along the first and second plates, respectively, in the mating space. A slot is defined between the first and second inner spring plates and extends between a front and a rear. The slot is configured to receive the header tab terminal through the front of the slot. The first and second inner spring plates are configured to directly engage and electrically connect the mating portion of the terminal body and the header tab terminal. The spring clip includes at least one cantilevered contact spring configured to be spring biased against and electrically connected to the header tab terminal. The spring clip includes at least one forward contact spring offset from the at least one cantilevered contact spring toward the front of the slot. The forward contact spring is configured to be spring biased against and electrically connected to the header tab terminal. The forward contact spring is configured to be unmated from the header tab terminal after the cantilevered contact spring is unmated from the header tab terminal when the electrical connector is unmated from the header connector.

In a further embodiment, an electrical connector system is provided including a header connector having a header housing holding a header tab terminal. The header tab terminal is oriented for mating in a mating direction along a mating axis. A family of electrical connectors is configured to be terminated to a high power wire and configured for mating with the header connector and the header tab terminal in the mating direction. Each of the family of electrical connectors includes a housing, a power terminal and a spring clip coupled to the power terminal. The housing is one of a right angle housing or an in-line housing. The power terminal is one of a crimp terminal or a weld tab terminal. The spring clip is one of a right-angle spring clip or an in-line spring clip. The housings, power terminals and spring clips are combined in one of a first arrangement, a second arrangement, a third arrangement or a fourth arrangement. In the first arrangement, a crimp barrel of the crimp terminal is crimped to the high power wire and the right angle spring clip is coupled to a mating portion of the crimp terminal. The crimp terminal and the right angle spring clip are loaded into the right angle housing with the high power wire being arranged perpendicular to the mating direction. In the second arrangement, the crimp barrel of the crimp terminal is crimped to the high power wire and the in-line spring clip is coupled to the mating portion of the crimp terminal. The crimp terminal and the in-line spring clip are loaded into the in-line housing with the high power wire being arranged parallel to the mating direction. In the third arrangement, a weld tab of the weld tab terminal is welded to the high power wire and the right angle spring clip is coupled to a mating portion of the weld tab terminal. The mating portion of the weld tab terminal is identical to the mating portion of the crimp terminal. The weld tab terminal and the right angle spring clip are loaded into the right angle housing with the high power wire being arranged perpendicular to the mating direction. In the fourth arrangement, the weld tab of the weld tab terminal is welded to the high power wire and the in-line spring clip is coupled to the mating portion of the weld tab terminal. The weld tab terminal and the in-line spring clip are loaded into the in-line housing with the high power wire being arranged parallel to the mating direction.

DETAILED DESCRIPTION OF THE INVENTION

Figure 1:
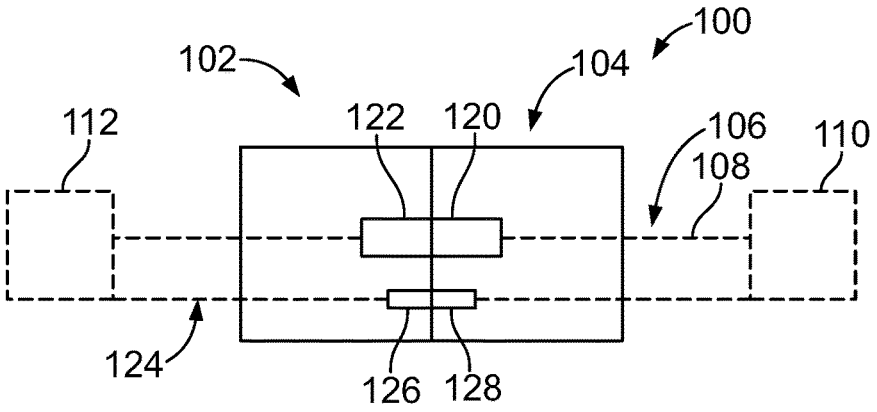
FIG. 1 is a schematic illustration of an electrical connector system formed in accordance with an exemplary embodiment.

FIG. 1 is a schematic illustration of an electrical connector system 100 formed in accordance with an exemplary embodiment. The electrical connector system 100 includes a header connector 102 and an electrical connector 104 configured to be mated with the header connector 102. In an exemplary embodiment, the electrical connector system 100 is a high power connector system that is used to transfer power between various components as part of a high power circuit 106. In a particular application, the electrical connector system 100 is a battery system, such as a battery system of a vehicle, such as an electric vehicle or hybrid electric vehicle; however the electrical connector system 100 is not intended to be limited to such battery systems.

The electrical connector 104 is configured to be electrically connected to a component 110, such as through one or more power wires 108. For example, the electrical connector 104 may be electrically connected to a motor. The header connector 102 is configured to be electrically connected to a component 112, such as through a direct power bus, bus terminal or power wire. For example, the header connector 102 may be electrically connected to a battery pack, such as through a battery distribution unit, a manual service disconnect or other component. The battery distribution unit may manage the power capacity and functionality of the electrical connector system 100, such as by measuring current and regulating power distribution of the battery pack.

Optionally, the electrical connector 104 may be removably coupled to the header connector 102 to disconnect the high power circuit 106 of one or more of the components, such as the battery pack, the motor or other components of the vehicle, such as for maintenance, repair or for another reason. When mated, one or more power terminals 120 of the electrical connector are terminated to corresponding header terminals 122 of the header connector 102, such as at mating interfaces thereof. Having a greater number terminals 120, 122 increases the current carrying capacity of the system 100. Optionally, each power terminal 120 may be terminated to a corresponding power wire 108.

In an exemplary embodiment, the header connector 102 and/or the electrical connector 104 may include a high voltage interlock (HVIL) circuit 124 to control the high voltage power circuit 106 during opening and closing or mating and unmating of the connectors 102, 104. For example, both connectors 102, 104 may include corresponding HVIL terminals 126, 128. The HVIL circuit 124 may be electrically connected to the component 112 and/or the component 110. In an exemplary embodiment, the electrical connector 104 utilizes a lever to unmate and/or mate the connectors 102, 104, which may open/close the high voltage circuit and the HVIL circuit during unmating/mating of the connectors 102, 104. The HVIL circuit may be opened first during unmating to shut of the high voltage circuit 106 prior to opening or unmating of the terminals 120, 122, which may reduce the likelihood of damage, such as from arcing. In an exemplary embodiment, the high voltage conducting surfaces of the connectors 102, 104 are finger proof and touch safe.

Figure 2:
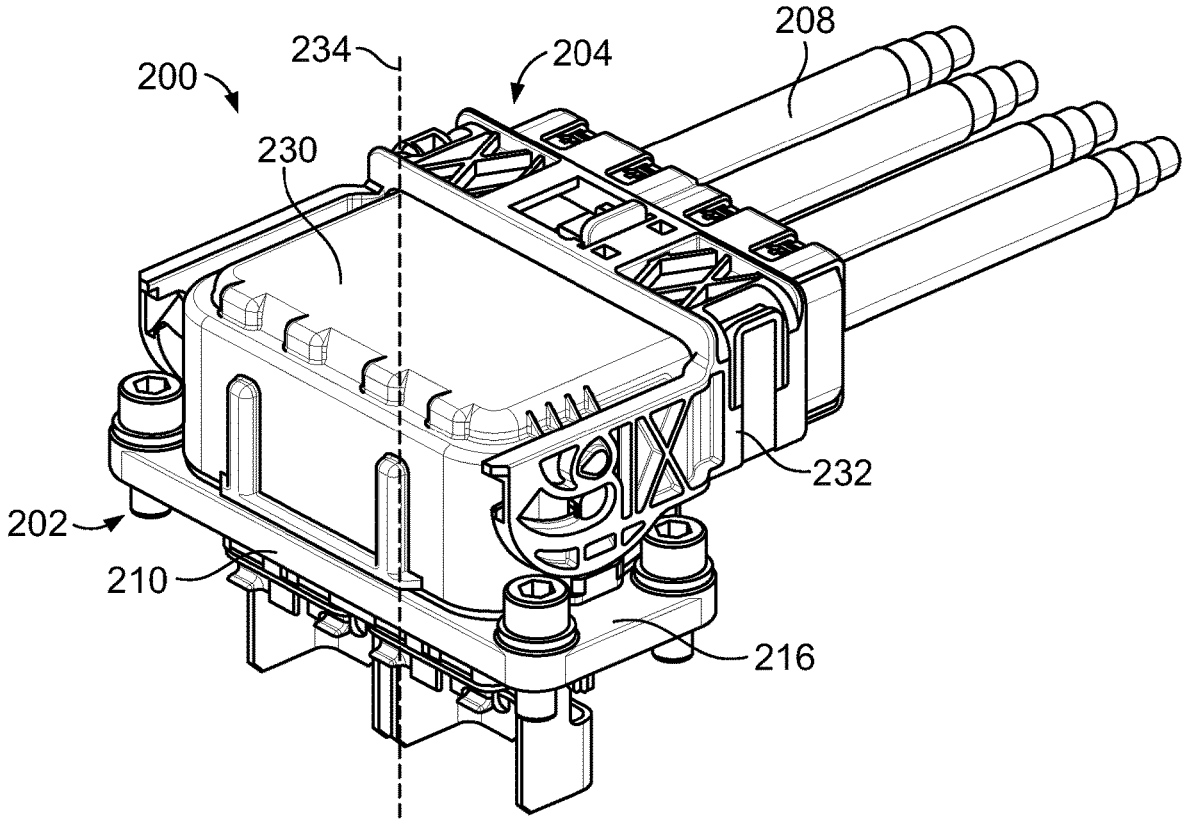
FIG. 2 is a perspective view of an electrical connector system formed in accordance with an exemplary embodiment including a header connector and an electrical connector mated with the header connector.
Figure 3:
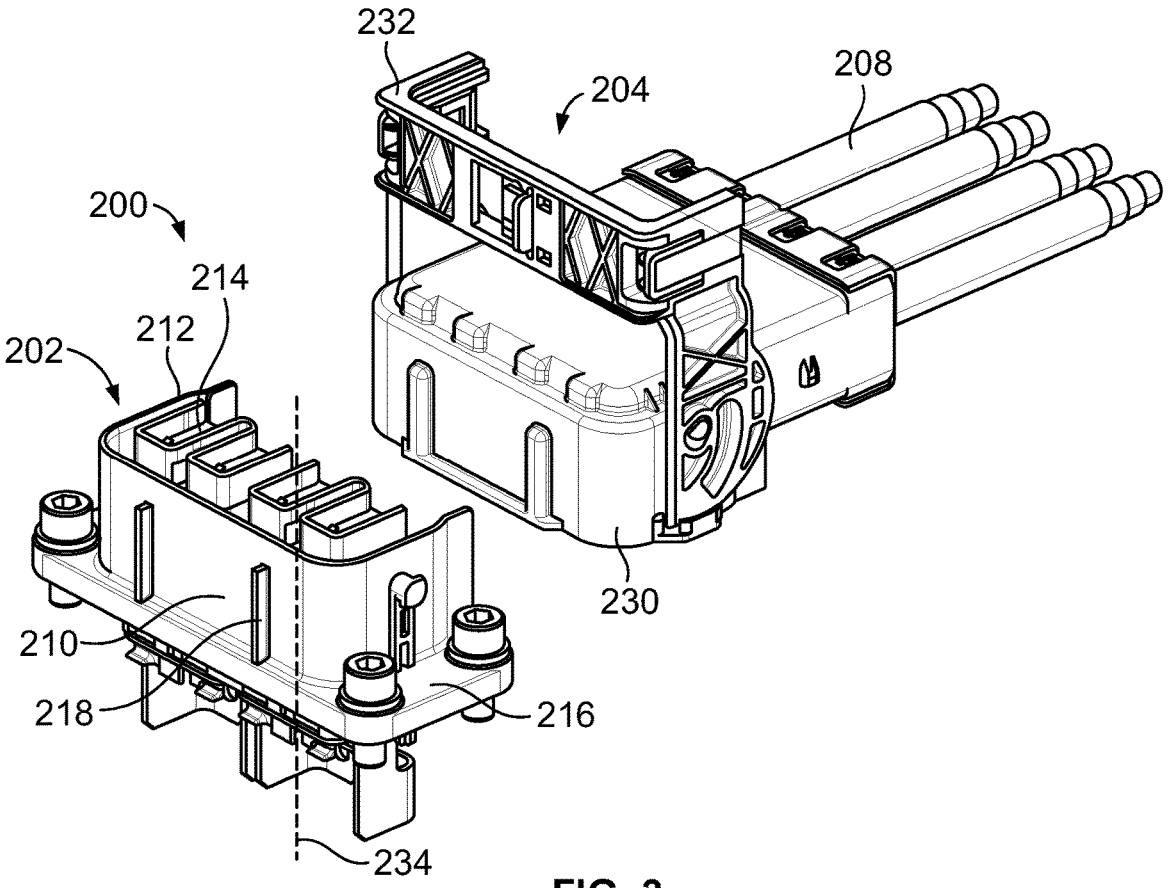
FIG. 3 is an exploded view of the electrical connector system shown in FIG. 2 showing the electrical connector poised for mating with the header connector.

FIG. 2 is a perspective view of an electrical connector system 200 formed in accordance with an exemplary embodiment including a header connector 202 and an electrical connector 204 mated with the header connector 202. FIG. 3 is an exploded view of the electrical connector system 200 showing the electrical connector 204 poised for mating with the header connector 202. FIG. 2 shows the electrical connector 204 in a mated state with the header connector 202. The electrical connector system 200 is an exemplary embodiment of the electrical connector system 100. The electrical connector system 200 is a right angle connector system where the connectors 202, 204 are mated in a direction perpendicular to the power wires. Components of the electrical connector system 200 may be used in whole or in part with the electrical connector system 100. Power wires 208 extend from the electrical connector 204 and may extend to a component, such as a motor. The header connector 202 is configured to be mounted to another component, such as a battery pack, a battery distribution unit, or another component.

The header connector 202 includes a header housing 210 having a mating end 212. The header housing 210 holds one or more header terminals 214. Optionally, the header terminals 214 may be tab terminals having generally planar mating tabs. The header tab terminals 214 may be shrouded to protect the header tab terminals 214. The header tab terminals 214 may have covers such that the header tab terminals 214 are touch safe. The header housing 210 includes a flange 216 for mounting the header housing 210 to another component. Optionally, the header housing 210 may be mounted horizontally; however, other orientations are possible in alternative embodiments. In an exemplary embodiment, the header housing 210 includes guide features 218 for guiding mating of the electrical connector 204 with the header connector 202. For example, the guide features 218 may be ribs, posts, slots, keying features or other types of guide features.

The electrical connector 204 includes a housing 230 configured to be coupled to the header housing 210. In an exemplary embodiment, the electrical connector 204 includes a lever 232 rotatably coupled to the housing 230. The lever 232 is configured to engage the header housing 210, such as corresponding guide features 218, to secure the electrical connector 204 to the header connector 202. Optionally, the lever 232 may include a slot that receives corresponding guide features 218 to control mating and unmating of the electrical connector 204 to the header connector 202. For example, as the lever 232 is closed the housing 230 may be pulled down onto the header housing 210. Conversely, as the lever 232 is raised, the housing 230 may be pressed away from and unmated from the header housing 210. The high power circuit and the HVIL circuit of the electrical connector system 200 may be opened and closed as the electrical connector 204 is unmated from and mated to the header connector 202.

In an exemplary embodiment, the housing 230 is a right angle housing 230 holding the power wires 208 and the power terminals perpendicular to a mating direction along a mating axis 234. The power wires 208 are at a right angle with respect to the mating axis 234. Other orientations are possible in alternative embodiments.

Figure 4:
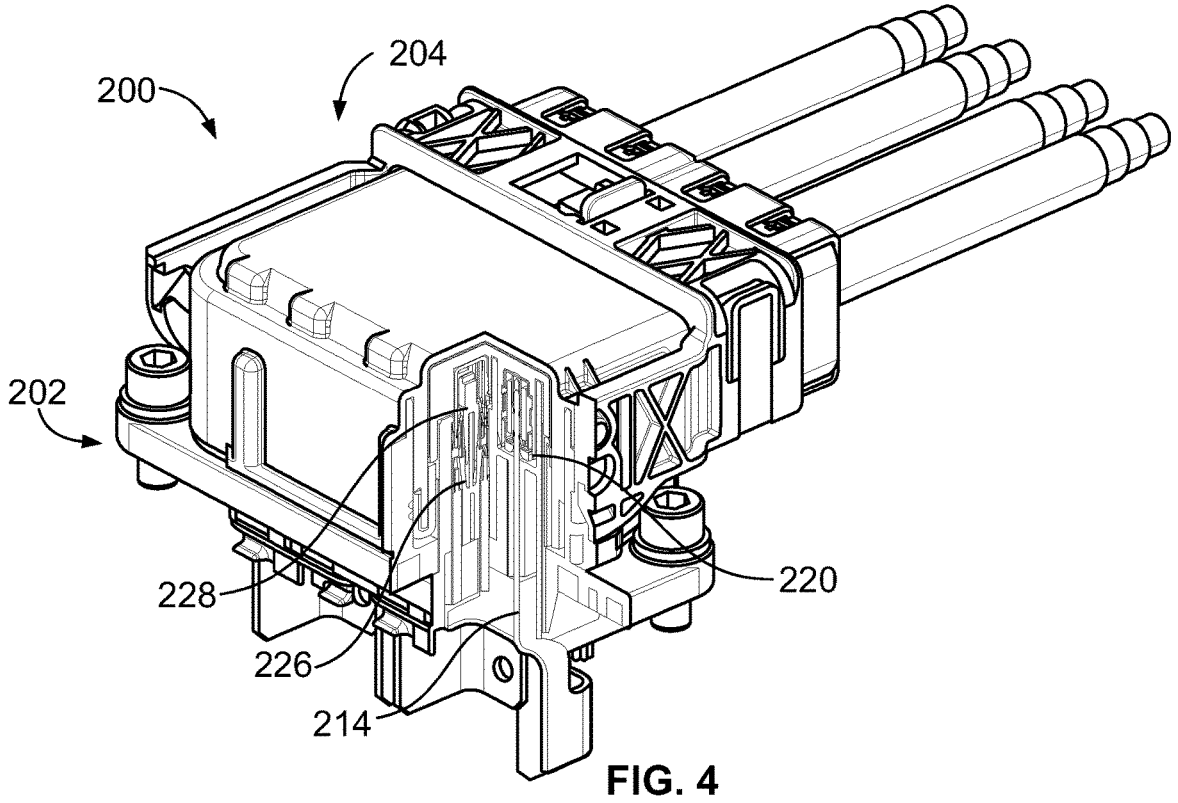
FIG. 4 is a partial sectional view of the electrical connector system shown in FIG. 2 showing the electrical connector mated with the header connector.

FIG. 4 is a partial sectional view of the electrical connector system 200 showing the electrical connector 204 mated with the header connector 202. Power terminals 220 of the electrical connector 204 are mated with and electrically connected to corresponding header tab terminals 214 of the header connector 202. In an exemplary embodiment, the header connector 202 includes one or more HVIL contacts 226 and the electrical connector 204 includes one or more HVIL terminals 228. In the mated position, the HVIL terminal 228 is electrically connected to the corresponding HVIL contacts 226. In the illustrated embodiment, the HVIL terminal 228 is a shunt terminal connected between two HVIL contacts 226. Other types of HVIL contacts or terminals may be used in alternative embodiments. In an exemplary embodiment, during unmating of the electrical connector 204 from the header connector 202, the HVIL terminal 228 is unmated from the HVIL contacts 226 prior to the power terminals 220 being unmated from the header tab terminals 214.

Figure 5:
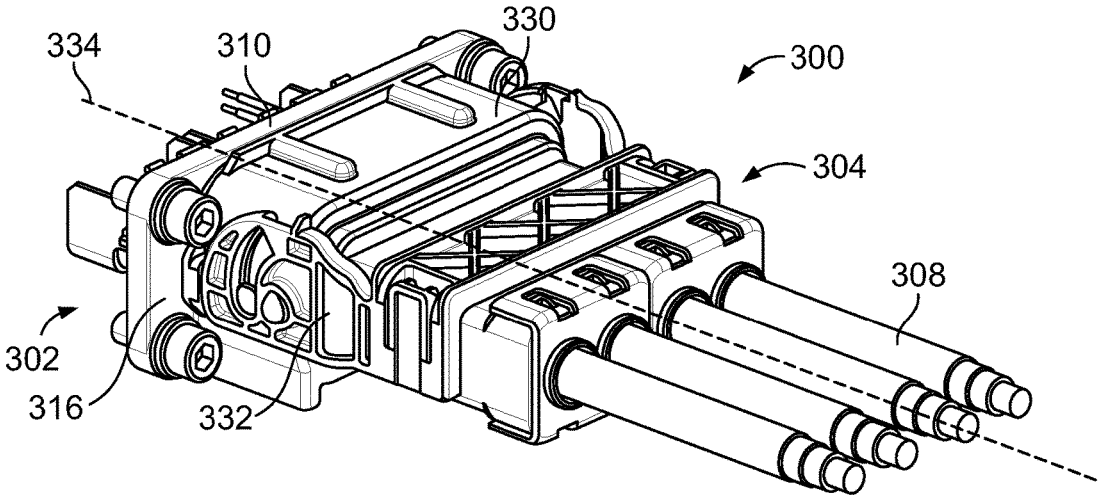
FIG. 5 is a perspective view of an electrical connector system formed in accordance with an exemplary embodiment including a header connector and an electrical connector mated with the header connector.
Figure 6:
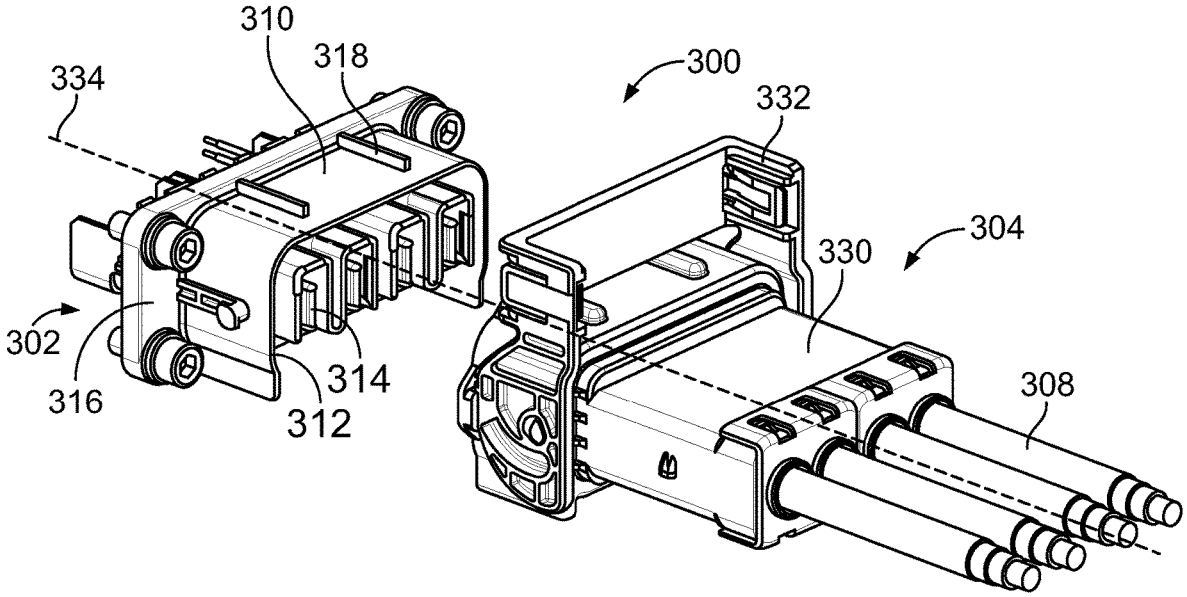
FIG. 6 is an exploded view of the electrical connector system shown in FIG. 5 showing the electrical connector poised for mating with the header connector.

FIG. 5 is a perspective view of an electrical connector system 300 formed in accordance with an exemplary embodiment including a header connector 302 and an electrical connector 304 mated with the header connector 302. FIG. 6 is an exploded view of the electrical connector system 300 showing the electrical connector 304 poised for mating with the header connector 302. FIG. 5 shows the electrical connector 304 in a mated state with the header connector 302. The electrical connector system 300 is an exemplary embodiment of the electrical connector system 100. The electrical connector system 300 is a straight-line connector system where the connectors 302, 304 are mated in a direction parallel to the power wires. Components of the electrical connector system 300 may be used in whole or in part with the electrical connector system 100. Power wires 308 extend from the electrical connector 304 and may extend to a component, such as a motor. The header connector 302 is configured to be mounted to another component, such as a battery pack, a battery distribution unit, or another component. Optionally, the header connector 302 may be identical to the header connector 202 (shown in FIG.

2) with the electrical connector 304 be mated in a different direction than the electrical connector 204 (shown in FIG. 2).

The header connector 302 includes a header housing 310 having a mating end 312. The header housing 310 holds one or more header tab terminals 314. The header tab terminals 314 may be shrouded to protect the header tab terminals 314. The header tab terminals 314 may have covers such that the header tab terminals 314 are touch safe. The header housing 310 includes a flange 316 for mounting the header housing 310 to another component. Optionally, the header housing 310 may be mounted vertically; however, other orientations are possible in alternative embodiments. In an exemplary embodiment, the header housing 310 includes guide features 318 for guiding mating of the electrical connector 304 with the header connector 302. For example, the guide features 318 may be ribs, posts, slots, keying features or other types of guide features.

The electrical connector 304 includes a housing 330 configured to be coupled to the header housing 310. In an exemplary embodiment, the electrical connector 304 includes a lever 332 rotatably coupled to the housing 330. The lever 332 is configured to engage the header housing 310, such as corresponding guide features 318, to secure the electrical connector 304 to the header connector 302. Optionally, the lever 332 may include a slot that receives corresponding guide features 318 to control mating and unmating of the electrical connector 304 to the header connector 302. For example, as the lever 332 is closed the housing 330 may be pulled down onto the header housing 310. Conversely, as the lever 332 is raised, the housing 330 may be pressed away from and unmated from the header housing 310. The high power circuit and the HVIL circuit of the electrical connector system 300 may be opened and closed as the electrical connector 304 is unmated from and mated to the header connector 302.

In an exemplary embodiment, the housing 330 is an in-line housing 330 holding the power wires 308 and the power terminals parallel to a mating direction along a mating axis 334. Other orientations are possible in alternative embodiments. The power terminals of the electrical connector 304 are mated with and electrically connected to corresponding header tab terminals 314 of the header connector 302.

Figure 8:
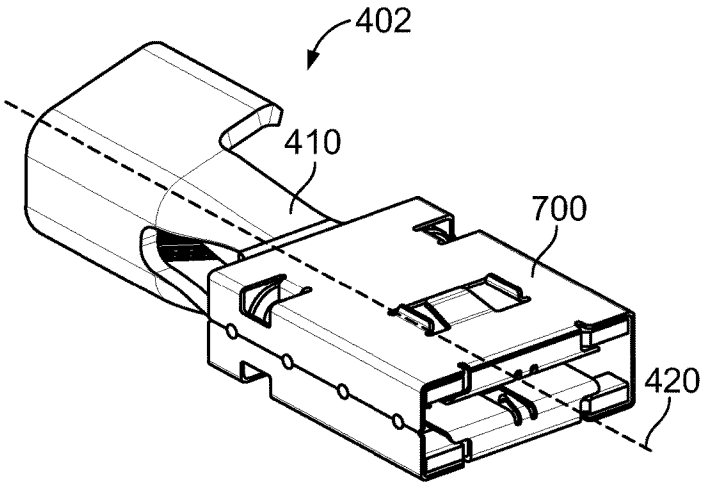
FIG. 8 illustrates an in-line crimp power terminal for the electrical connectors formed in accordance with an exemplary embodiment.
Figure 10:
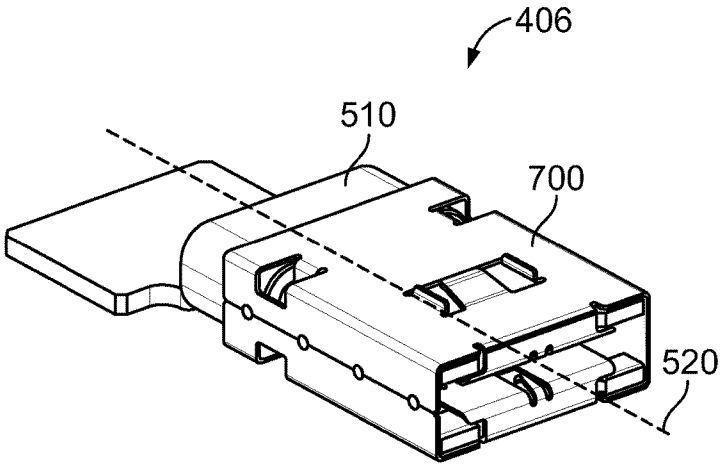
FIG. 10 illustrates an in-line weld tab power terminal for the electrical connectors formed in accordance with an exemplary embodiment.
Figure 7:
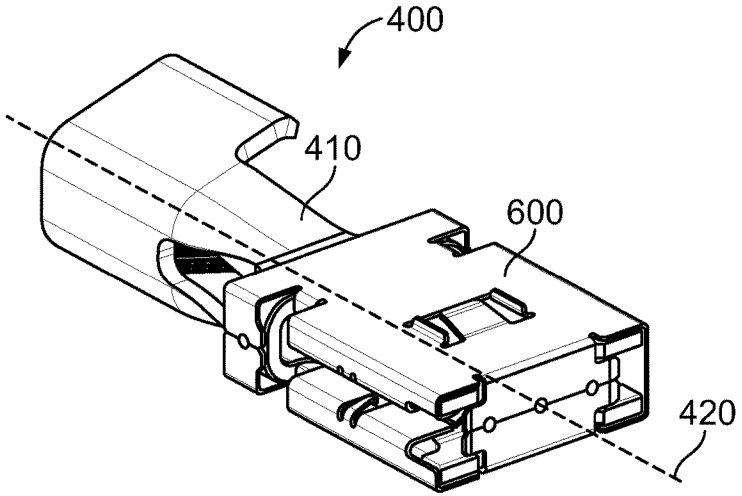
FIG. 7 illustrates a right angle crimp power terminal for the electrical connectors formed in accordance with an exemplary embodiment.
Figure 9:
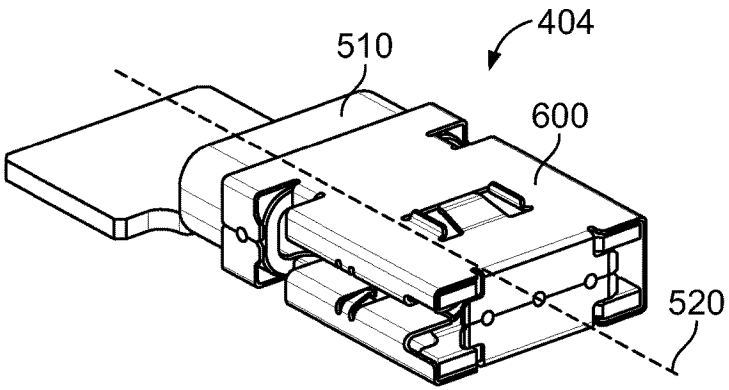
FIG. 9 illustrates a right angle weld tab power terminal for the electrical connectors formed in accordance with an exemplary embodiment.

FIGS. 7-10 illustrate power terminals for the various electrical connectors. For example, the power terminals may be used in the electrical connector 104, 204 and/or 304. FIG. 7 illustrates a right angle crimp power terminal 400. FIG. 8 illustrates an in-line crimp power terminal 402. FIG. 9 illustrates a right angle weld tab power terminal 404. FIG. 10 illustrates an in-line weld tab power terminal 406. The power terminals 400-406 illustrate a family of power terminals. The power terminals 400-406 include various features for interfacing with the power wires and the header tab terminals. For example, the power terminals 400, 402 are both configured to be crimped to power wires, whereas the power terminals 404, 406 are both configured to be welded to the power wires. The power terminals 400, 404 are both configured to be mated at a right angle with the corresponding header tab terminal, whereas the power terminals 402, 406 are both configured to be mated in-line with the corresponding header tab terminals. Component parts of the power terminals 400-406 are usable in various multiple power terminals 400-406 to reduce the overall part count of the family of power terminals.

Figure 11:
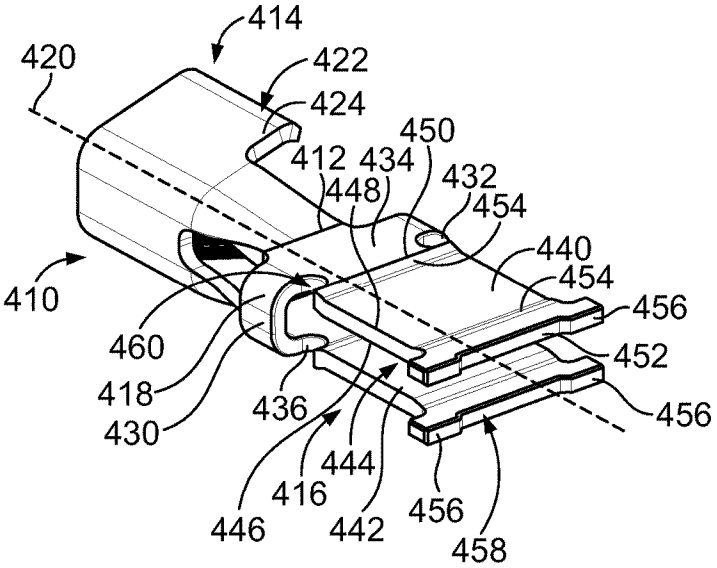
FIG. 11 illustrates a crimp terminal for the crimp power terminals formed in accordance with an exemplary embodiment.

FIG. 11 illustrates a crimp terminal 410 having a terminal body 412 extending between a terminating end and a mating end. The terminal body 412 includes a terminating portion 414 at the terminating end, a mating portion 416 at the mating end and a base 418 between the terminating portion 414 and the mating portion 416.

The crimp terminal 410 extends longitudinally along a longitudinal axis 420. The power wire is configured to extend away from the terminating portion 414 along the longitudinal axis 420. The base 418 is positioned between the terminating portion 414 and the mating portion 416 along the longitudinal axis 420.

The terminating portion 414 includes a crimp barrel 422 configured to be crimped to a corresponding power wire. The crimp barrel 422 includes opposed wire grips 424 that are configured to grip the power wire when the crimp barrel 422 is crimped to the power wire. The crimp barrel 422 may have any shape configured to be crimped to the power wire.

In an exemplary embodiment, the base 418 wraps entirely around the terminal body 412. Alternatively, the base 418 may wrap only partially around. For example, the base 418 may include one or more strips wrapping non-continuously around the terminal body 412. In the illustrated embodiment, the base 418 includes ends 430, 432 and sides 434, 436. In the illustrated embodiment, the sides 434, 436 are longer than the ends 430, 432.

The mating portion 416 includes first and second plates 440, 442 opposing each other across a mating space 444. The crimp terminal 410 is configured to receive the corresponding header tab terminal in the mating space 444. In an exemplary embodiment, the plates 440, 442 each include an interior 446 defining the mating space 444 therebetween and an exterior 448 opposite the interior 446. The plates 440, 442 extend between an inner end 450 and an outer end 452. The inner end 450 is provided at the base 418 while the outer end 452 is the distal end of the corresponding plates 440, 442. Optionally, the central portion of the plates 440, 442 may be recessed towards each other in the mating space 444. For example, lips 454 may be provided at or near the inner and outer ends 450, 452 to recess the central portion inward. In an exemplary embodiment, the plates 440, 442 include flanges 456 at the outer end 452. The flanges 456 may be wider and/or longer than other portions of the plates 440, 442. For example, one or more windows 458 may be defined between corresponding flanges 456. In an exemplary embodiment, the crimp terminal 410 includes pockets 460 between the base 418 and the inner end 450 of the plates 440, 442. The flanges 456, the windows 458, the pockets 460 and/or other components or features may be used to secure other components to the crimp terminal 410, such as spring clips.

Figure 12:
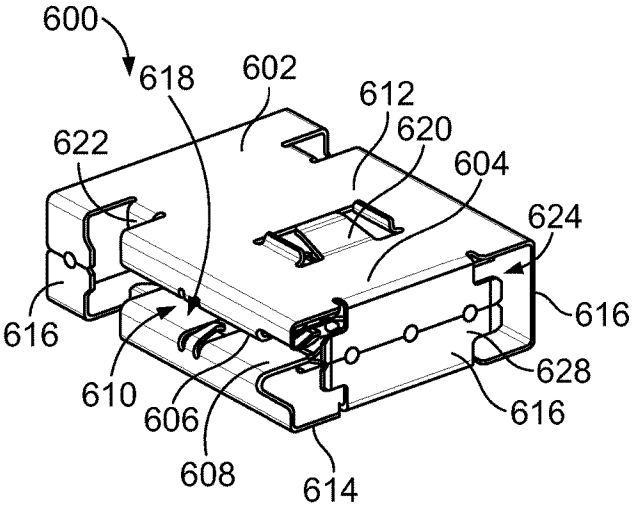
FIG. 12 illustrates a weld tab terminal for the crimp power terminals formed in accordance with an exemplary embodiment.

FIG. 12 illustrates a weld tab terminal 510 formed in accordance with an exemplary embodiment. The weld tab terminal 510 has a terminal body 512 extending between a terminating end and a mating end. The terminal body 512 includes a terminating portion 514 at the terminating end, a mating portion 516 at the mating end and a base 518 between the terminating portion 514 and the mating portion 516.

The weld tab terminal 510 extends longitudinally along a longitudinal axis 520. The terminating portion 514 includes a weld tab 522 having a welding surface 524 configured to be welded to a corresponding power wire. The power wire is configured to extend away from the terminating portion 514 along the longitudinal axis 520, perpendicular to the longitudinal axis 520 or at another angle after being welded thereto. The base 518 is positioned between the terminating portion 514 and the mating portion 516 along the longitudinal axis 520.

In an exemplary embodiment, the base 518 wraps entirely around the terminal body 512. Alternatively, the base 518 may wrap only partially around. For example, the base 518 may include one or more strips wrapping non-continuously around the terminal body 512. In the illustrated embodiment, the base 518 includes ends 530, 532 and sides 534, 536. In the illustrated embodiment, the sides 534, 536 are longer than the ends 530, 532. Optionally, the base 518 may have the same profile as the base 418 (e.g., ends 530, 532 and sides 534, 536 having the same lengths as the ends 430, 432 and sides 434, 436 all shown in FIG. 11).

The mating portion 516 includes first and second plates 540, 542 opposing each other across a mating space 544. Optionally, the mating portion 516 may be identical to the mating portion 416 (e.g., have identical plates as the plates 440, 442 all shown in FIG. 11). The weld tab terminal 510 is configured to receive the corresponding header tab terminal in the mating space 544. In an exemplary embodiment, the plates 540, 542 each include an interior 546 defining the mating space 544 therebetween and an exterior 548 opposite the interior 546. The plates 540, 542 extend between an inner end 550 and an outer end 552. The inner end 550 is provided at the base 518 while the outer end 552 is the distal end of the corresponding plates 540, 542. Optionally, the central portion of the plates 540, 542 may be recessed towards each other in the mating space 544. For example, lips 554 may be provided at or near the inner and outer ends 550, 552 to recess the central portion inward. In an exemplary embodiment, the plates 540, 542 include flanges 556 at the outer end 552. The flanges 556 may be wider and/or longer than other portions of the plates 540, 542. For example, one or more windows 558 may be defined between corresponding flanges 556. In an exemplary embodiment, the weld tab terminal 510 includes pockets 560 between the base 518 and the inner end 550 of the plates 540, 542. The flanges 556, the windows 558, the pockets 560 and/or other components or features may be used to secure other components to the weld tab terminal 510, such as spring clips.

Figure 13:
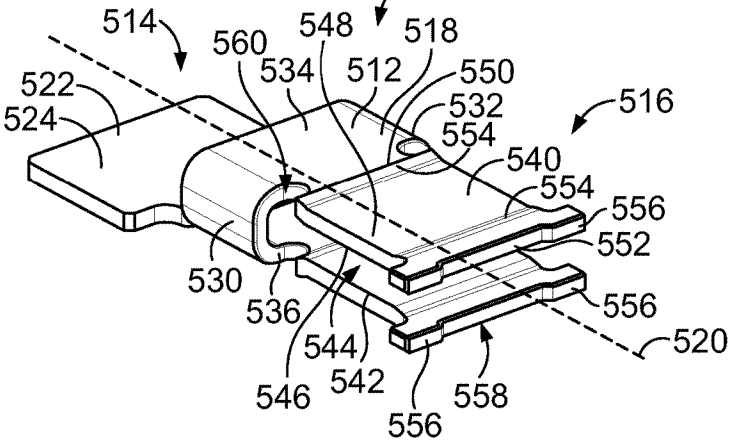
FIG. 13 illustrates a right angle spring clip for the power terminals formed in accordance with an exemplary embodiment.

FIG. 13 illustrates a right angle spring clip 600 formed in accordance with an exemplary embodiment. The spring clip 600 includes a spring clip body 602. In an exemplary embodiment, the spring clip body 602 is stamped and formed from a conductive sheet. In the illustrated embodiment, the spring clip body 602 includes an outer shell 604, which is generally box shaped. The outer shell 604 may have other shapes in alternative embodiments. In an exemplary embodiment, the spring clip 600 includes first and second inner spring plates 606, 608 folded inward into the interior of the outer shell 604. The spring clip body 602 includes a slot 610 defined between the first and second inner spring plates 606, 608. The slot 610 is configured to receive the corresponding header tab terminal. The inner spring plates 606, 608 are configured to be electrically connected to the corresponding header tab terminal. The inner spring plates 606, 608 are configured to be electrically connected to the corresponding terminal body of the power terminal to electrically connect the power terminal to the header tab terminal. In various embodiments, the spring clip body 602 only includes a single inner spring plate 606 or 608.

In an exemplary embodiment, the spring clip body 602 includes opposed first and second sides 612, 614 and ends 616 extending between the sides 612, 614. In the illustrated embodiment, the sides 612, 614 are upper and lower sides; however, the spring clip 600 may be arranged in any orientation and does not require the sides 612, 614 to be upper and lower sides. One of the ends 616 is a loading end and is open to receive the corresponding terminal body of the corresponding power terminal. One of the ends 616 includes an opening 618 to the slot 610. Other of the ends 616 may be closed by end walls 628.

In an exemplary embodiment, the spring clip body 602 includes one or more housing latches 620 used to secure the spring clip 600 in the corresponding housing of the electrical connector. The housing latches 620 may be deflectable. Optionally, both sides 612, 614 include housing latches 620. The spring clip body 602 includes a plurality of power terminal latches 622 configured to engage and hold the spring clip on the corresponding terminal body of the power terminal. For example, the power terminal latches 622 may be formed in the sides 612, 614 and bent inward into the interior of the spring clip 600. The spring clip body 602 includes windows 624 that receive portions of the power terminal to position the spring clip 600 on the corresponding terminal body of the power terminal. The spring clip 600 may include other features to interact with the corresponding terminal body of the corresponding power terminal.

Figure 14:
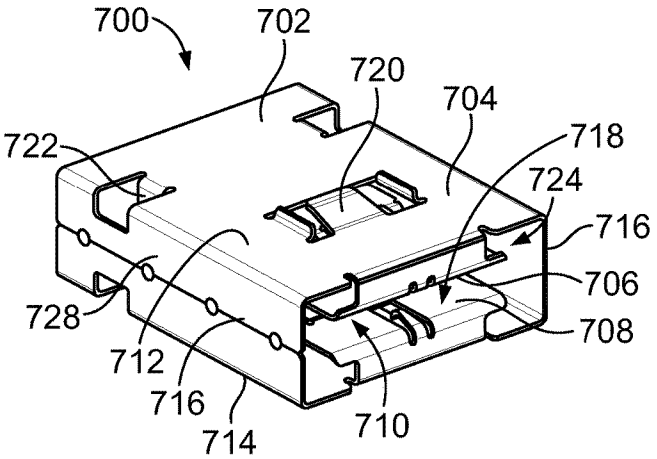
FIG. 14 is a perspective view of an in-line spring clip for the power terminals formed in accordance with an exemplary embodiment.

FIG. 14 is a perspective view of an in-line spring clip 700 formed in accordance with an exemplary embodiment. The spring clip 700 includes a spring clip body 702. In an exemplary embodiment, the spring clip body 702 is stamped and formed from a conductive sheet. In the illustrated embodiment, the spring clip body 702 includes an outer shell 704, which is generally box shaped. The outer shell 704 may have other shapes in alternative embodiments. In an exemplary embodiment, the spring clip 700 includes first and second inner spring plates 706, 708 folded inward into the interior of the outer shell 704. The spring clip body 702 includes a slot 710 defined between the first and second inner spring plates 706, 708. The slot 710 is configured to receive the corresponding header tab terminal. In an exemplary embodiment, the slot 710 is provided opposite the loading end. The inner spring plates 706, 708 are configured to be electrically connected to the corresponding header tab terminal. The inner spring plates 706, 708 are configured to be electrically connected to the corresponding terminal body of the power terminal to electrically connect the power terminal to the header tab terminal. In various embodiments, the spring clip body 702 only includes a single inner spring plate 706 or 708.

In an exemplary embodiment, the spring clip body 702 includes opposed first and second sides 712, 714 and ends 716 extending between the sides 712, 714. In the illustrated embodiment, the sides 712, 714 are upper and lower sides; however, the spring clip 700 may be arranged in any orientation and does not require the sides 712, 714 to be upper and lower sides. One of the ends 716 is a loading end and is open to receive the corresponding terminal body of the corresponding power terminal. The end 716 opposite the loading end includes an opening 718 to the slot 710. Other of the ends 716 may be closed by end walls 728.

In an exemplary embodiment, the spring clip body 702 includes one or more housing latches 720 used to secure the spring clip 700 in the corresponding housing of the electrical connector. The housing latches 720 may be deflectable. Optionally, both sides 712, 714 include housing latches 720. The spring clip body 702 includes a plurality of power terminal latches 722 configured to engage and hold the spring clip on the corresponding terminal body of the power terminal. For example, the power terminal latches 722 may be formed in the sides 712, 714 and bent inward into the interior of the spring clip 700. The spring clip body 702 includes windows 724 that receive portions of the power terminal to position the spring clip 700 on the corresponding terminal body of the power terminal. The spring clip 700 may include other features to interact with the corresponding terminal body of the corresponding power terminal.

Returning to FIGS. 7-10 the power terminals 400, 402, 404, 406 are combinations of the various components, such as the crimp terminal 410, the weld tab terminal 510, the right angle spring clip 600 and the in-line spring clip 700. For example, the right angle crimp power terminal 400 includes the crimp terminal 410 and the right angle spring clip 600 coupled to the crimp terminal 410. The in-line crimp power terminal 402 includes the crimp terminal 410 with the in-line spring clip 700 coupled to the crimp terminal 410. The right angle weld tab power terminal 404 includes the weld tab terminal 510 and the right angle spring clip 600 coupled to the weld tab terminal 510. The in-line weld tab power terminal 406 includes the weld tab terminal 510 and the in-line spring clip 700 coupled to the weld tab terminal 510. As such, the combination of two different types of terminals, namely the crimp terminal 410 and the weld tab terminal 510, and two different types of spring clips, namely the right angle spring clip 600 and the in-line spring clip 700, yields four different types of power terminal for use in the various electrical connector systems. Both spring clips 600, 700 are able to be connected to either type of terminal 410, 510 because the terminals 410, 510 include substantially similar locating and securing features and both the spring clips 600, 700 include substantially similar locating and securing features. As such, to change the mating orientation of the crimp terminal 410 or the weld tab terminal 510 from mating perpendicular to the longitudinal axis 420, 520 to parallel to the longitudinal axis 420, 520, the assembler merely selects the right angle spring clip 600 or the in-line spring clip 700 and couples such spring clip 600, 700 to the crimp terminal 410 or the weld tab terminal 510. As such, a family of power terminals 400-406 is provided with a limited number of parts, namely two different types of terminals (configured to be terminated to the power wire in different manners) and two different types of spring clips.

Figure 15:
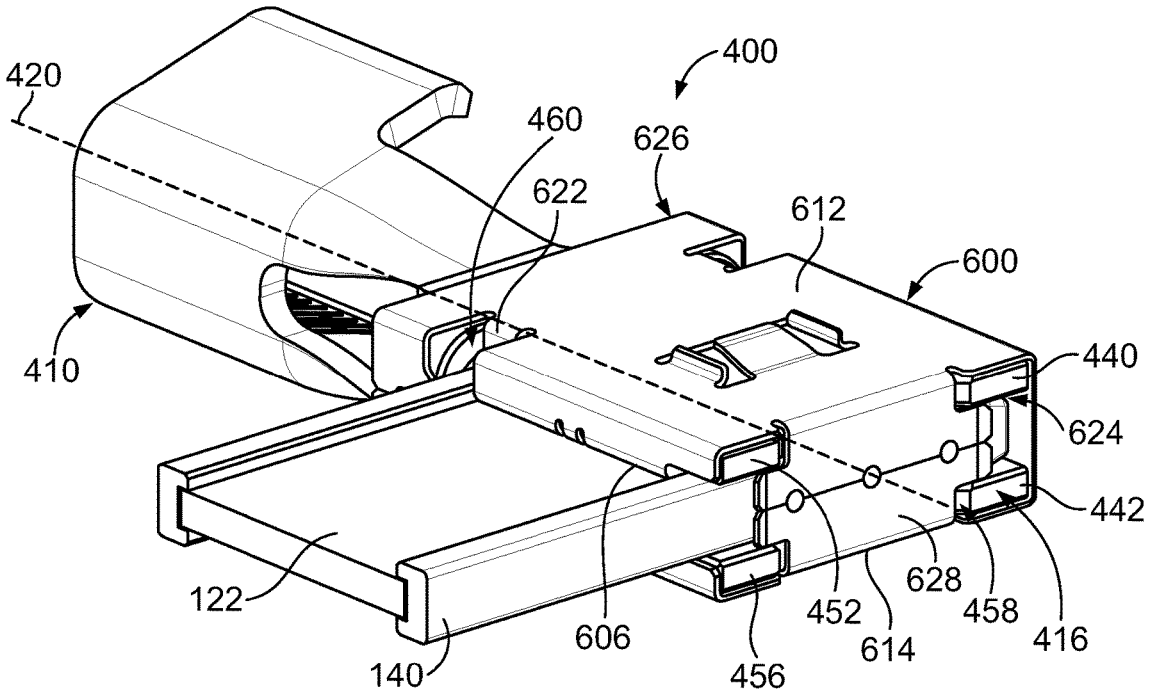
FIG. 15 illustrates one of the power terminal terminated to a header tab terminal.

FIG. 15 illustrates the right angle crimp power terminal 400 terminated to the corresponding header tab terminal 122. The right angle crimp power terminal 400 is mated to the header tab terminal 122 in a mating direction that is perpendicular to the longitudinal axis 420. The right angle spring clip 600 receives the header tab terminal 122 at a right angle or 90° with respect to the longitudinal axis 420. The right angle weld tab terminal 404 (shown in FIG. 9) may receive the right angle spring clip 600 in a similar manner as described herein.

The right angle spring clip 600 is coupled to the crimp terminal 410. For example, the spring clip 600 may be loaded onto the mating portion 416 through a loading end 626 of the spring clip 600. The first and second plates 440, 442 may be positioned between the inner spring plates 606, 608 and the first and second sides 612, 614, respectively. As such, the inner spring plates 606, 608 wrap around the plates 440, 442 of the mating portion 416 of the crimp terminal 410. The power terminal latches 622 may be bent into place after the spring clip 600 is coupled to the mating portion 416. For example, the power terminal latches 622 may be bent into corresponding pockets 460. When the spring clip 600 is coupled to the crimp terminal 410, an end wall 628 at the end opposite the loading end 626 is received in the windows 458 at the outer ends 452 of the plates 440, 442. The flanges 456 may protrude at least partially through the windows 624 in the spring clip 600. In an exemplary embodiment, the flanges 456 of the first and second plates 440, 442 are spaced apart far enough to accommodate the touch safe cover 140 on the header tab terminal 122.

Figure 16:
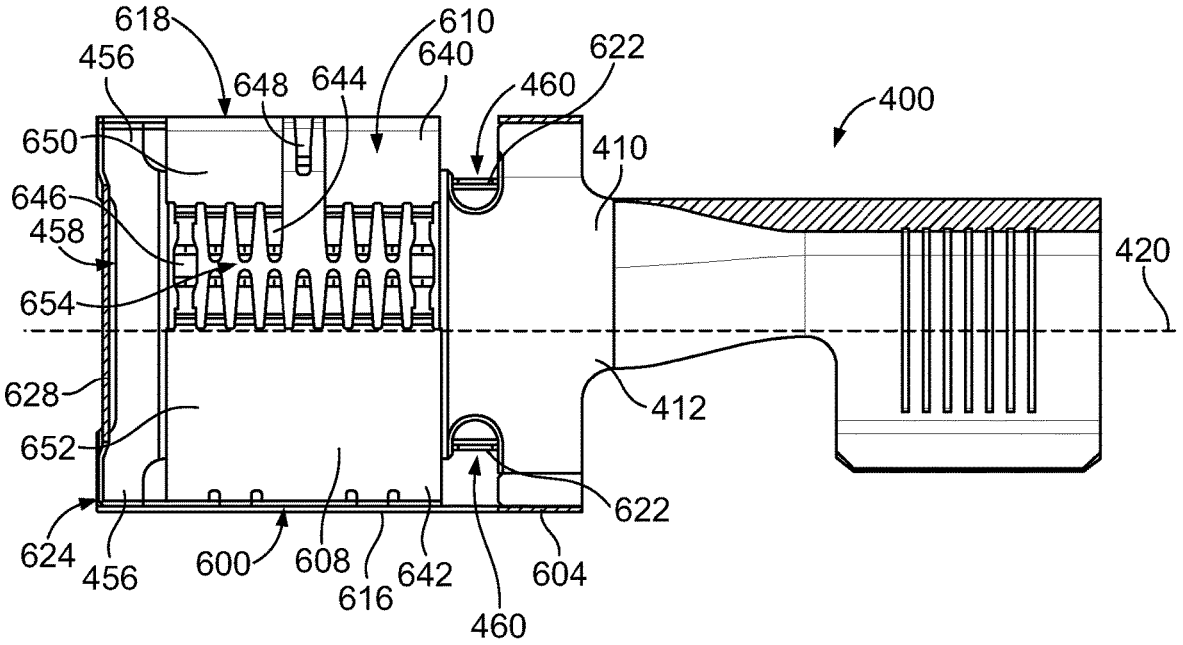
FIG. 16 is a cross-sectional view of the power terminal shown in FIG. 15.

FIG. 16 is a cross-sectional view of the right angle crimp power terminal 400 showing the right angle spring clip 600 coupled to the crimp terminal 410. FIG. 16 illustrates the inner spring plate 608; however, it is realized that the inner spring plate 606 (shown in FIG. 15) may include similar or identical features as the inner spring plate 608. The walls of the spring clip body 602 wrap snugly around the crimp terminal 410 to position the spring clip 600 on the crimp terminal 410. For example, the power terminal latches 622 are received in corresponding pockets 460. The end wall 628 is received in the corresponding window 458. The flanges 456 are received in corresponding windows 624.

The inner spring plate 608 extends from a front 640 to a rear 642. The front 640 is generally defined at the opening 618 to the slot 610. The rear 642 may extend to the end 616 of the outer shell 604 generally opposite the opening 618. In the illustrated embodiment, the spring clip 600 is oriented such that the inner spring plate 608 extends across the crimp terminal 410 (e.g., perpendicular to the longitudinal axis 420).

The inner spring plate 608 includes a plurality of contact springs that are used to electrically and mechanically engage the header tab terminal and/or the terminal body 412. In an exemplary embodiment, the inner spring plate 608 includes different types of contact springs to provide different functions. For example, the inner spring plate 608 includes one or more cantilevered contact springs 644, one or more stabilization contact springs 646, and one or more forward contact springs 648. The cantilevered contact springs 644 provide the main electrical connection to the header tab terminal 122. The stabilization contact springs 646 provide the main mechanical connection with the header tab terminal. The forward contact spring 648 provides the last mated interface between the power terminal 400 and the header tab terminal during unmating to ensure that the HVIL circuit is opened prior to the high power circuit being opened. In the illustrated embodiment, the forward contact spring 648 is the forward most contact spring, closest to the front 640. In the illustrated embodiment, the cantilevered contact springs 644 and the stabilization contact springs 646 are provided at or near a central portion of the inner spring plate 608.

The inner spring plate 608 includes a forward plate portion 650 and a rearward plate portion 652 separated by one or more openings 654. The contact springs 644, 646, 648 may be stamped from the inner spring plate 608 at the one or more opening 654. In an exemplary embodiment, the stabilization contact springs 646 bridge between and connect to both the forward plate portion 650 and the rearward plate portion 652. Optionally, the stabilization contact springs 646 may be the only portions of the inner spring plate 608 spanning between the forward plate portion 650 and the rearward plate portion 652.

In an exemplary embodiment, the cantilevered contact springs 644 extend only partially across the opening 654. For example, in the illustrated embodiment, the inner spring plate 608 includes a plurality of cantilevered contact springs 644 extending from the forward plate portion 650 and a plurality of cantilevered contact springs 644 extending from the rearward plate portion 652. Optionally, such cantilevered contact springs 644 may oppose each other across the opening 654.

Any number of contact springs may be provided. In the illustrated embodiment, the inner spring plate 608 includes a pair of stabilizing contact springs 646 flanking a plurality of the cantilevered contact springs 644. The stabilization contact springs 646 are provided as the outer most contact springs while the cantilevered contact springs 644 are the inner contact springs.

Figure 17:
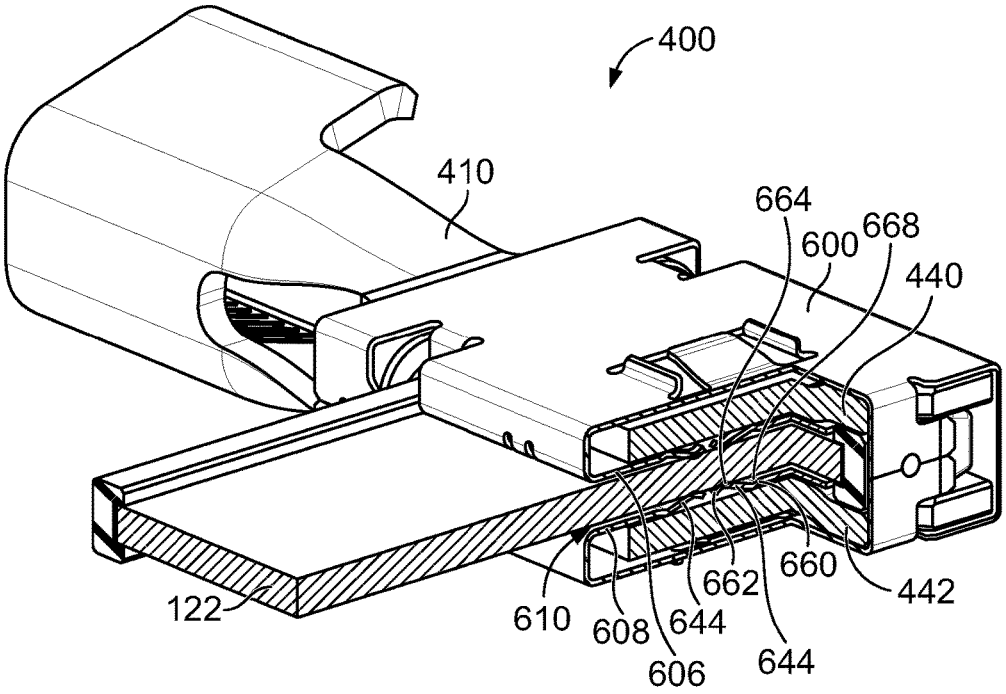
FIG. 17 is a partial sectional view of the power terminal shown in FIG. 15.
Figure 18:
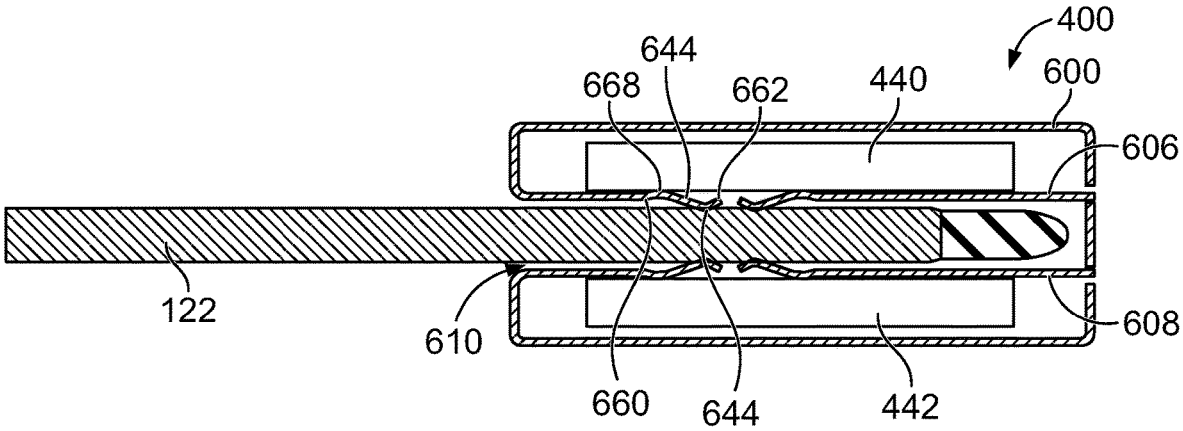
FIG. 18 is a cross sectional view of the power terminal shown in FIG. 15.

FIG. 17 is a partial sectional view of the right angle crimp power terminal 400 mated to the header tab terminal 122. FIG. 18 is a cross sectional view of the right angle crimp power terminal 400 mated to the header tab terminal 122. FIGS. 17 and 18 illustrate the cantilevered contact springs 644 spring biased against and electrically connected to the header tab terminal 122 and the plates 440, 442 of the crimp terminal 410.

The cantilevered contact springs 644 include fixed ends 660 extending from the corresponding inner spring plates 606, 608 and free ends 662 configured to be resiliently deflected against the header tab terminal 122 when the header tab terminal 122 is received in the slot 610.

In an exemplary embodiment, the free ends 662 are curved and define bumps configured to engage the header tab terminal 122. The bumps define contact interfaces 664 with the header tab terminal 122. When the cantilevered contact springs 644 are resiliently deflected outward by the header tab terminal 122, the cantilevered contact springs 644 are spring biased against the header tab terminal 122 and provide a contact normal force against the header tab terminal 122, ensuring electrical connection between the cantilevered contact springs 644 and the header tab terminal 122.

In an exemplary embodiment, the fixed ends 660 include knuckles 668 protruding toward the plates 440, 442 of the crimp terminal 410. The knuckles 668 define contact interfaces 664 with the plates 440, 442. As such, the spring clip 660 is electrically connected to the crimp terminal 410 though the plates 440, 442. The spring clip 600 is electrically connected to the header tab terminal 122 through the cantilevered contact springs 644. In an exemplary embodiment, the cantilevered contact springs 644 define multiple points of contact with the power terminal 400 and multiple points of contact with the header tab terminal 122. An electrical connection is made between the crimp terminal 410 and the header tab terminal 122 through the spring clip 600.

Figure 19:
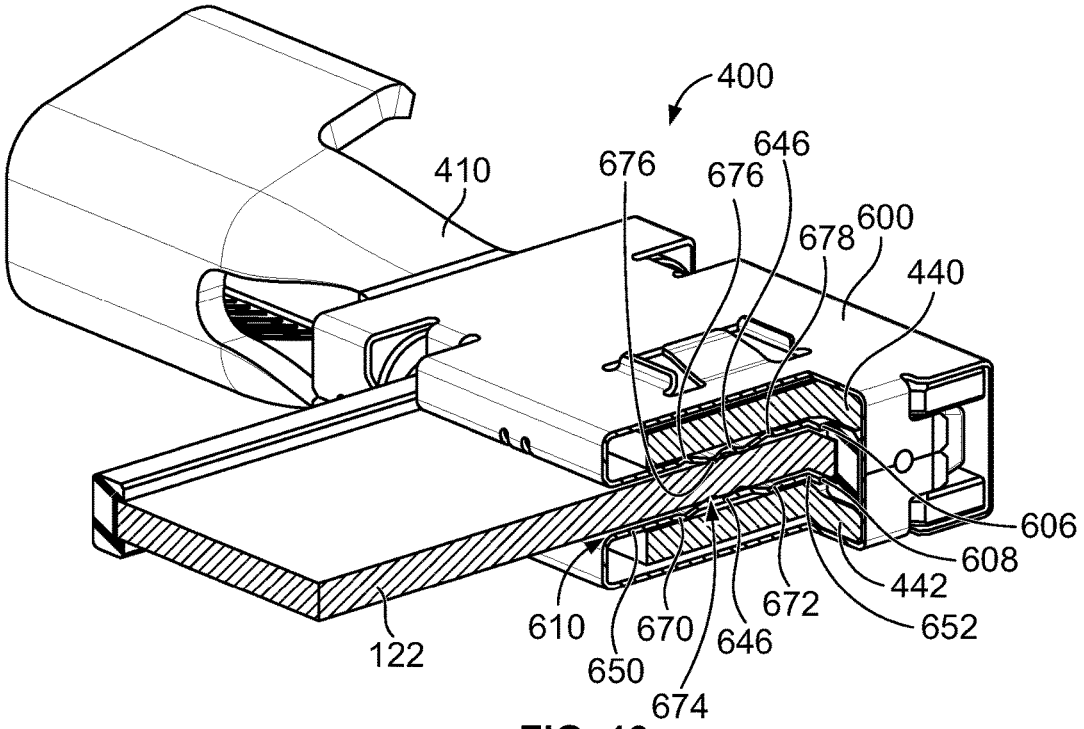
FIG. 19 is a partial sectional view of the power terminal shown in FIG. 15.
Figure 20:
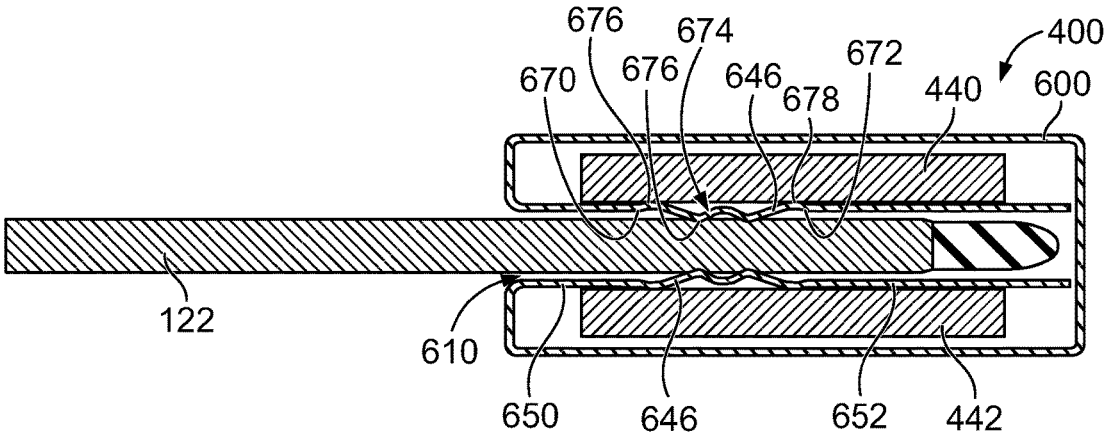
FIG. 20 is a cross sectional view of the power terminal shown in FIG. 15.

FIG. 19 is a partial sectional view of the right angle crimp power terminal 400 mated to the header tab terminal 122. FIG. 20 is a cross sectional view of the right angle crimp power terminal 400 mated to the header tab terminal 122. FIGS. 19 and 20 illustrate the stabilization contact springs 646 spring biased against and electrically connected to the header tab terminal 122 and the plates 440, 442 of the crimp terminal 410.

The stabilization contact springs 646 each include a first fixed end 670 and a second fixed end 672 fixed to the forward plate portion 650 and the rearward plate portion 652, respectively. The stabilization contact springs 646 include a mating hub 674 mated with the header tab terminal 122. The mating hub 674 may be approximately centered between the fixed ends 670, 672. The mating hub 674 is configured to be resiliently deflected against the header tab terminal 122 when the header tab terminal 122 is received in the slot 610.

In an exemplary embodiment, the mating hub 674 may include one or more curves defining bumps configured to engage the header tab terminal 122. Optionally, the stabilization contact spring 646, including the mating hub, may have an M-shape or W-shape defining multiple points of contact with the header tab terminal 122. The bumps define contact interfaces 676 with the header tab terminal 122.

When the stabilization contact springs 646 are resiliently deflected outward from the slot 610 by the header tab terminal 122, the mating hub 674 is spring biased against the header tab terminal 122 and provides a contact normal force against the header tab terminal 122, ensuring a strong mechanical and electrical connection between the stabilization contact spring 646 and the header tab terminal 122. Because the stabilization contact spring 646 is fixed at both ends, the amount of deflection causes a greater normal force pressing against the header tab terminal 122 than the cantilevered contact spring 644 (shown in FIGS. 17-18). As such, the normal force imparted by each stabilization contact spring 646 is greater than the normal force imparted by any cantilevered contact spring 644.

In an exemplary embodiment, the fixed ends 670, 672 include knuckles 678 protruding toward the plates 440, 442 of the crimp terminal 410. The knuckles 678 define contact interfaces 676 with the plates 440, 442. Optionally, when the stabilization contact spring 646 is deflected by the header tab terminal 122, a central portion of the mating hub 674 may be pressed outward against the corresponding plate 440, 442 to define a contact interface 676 between the mating hub 674 and the plate 440, 442. Such engagement with the plate 440, 442 by the mating hub 674 may increase the contact normal force of the stabilization contact spring 646 against the header tab terminal 122.

The spring clip 600 is electrically connected to the crimp terminal 410 though the plates 440, 442. The spring clip 600 is electrically connected to the header tab terminal 122 through the cantilevered contact springs 644. In an exemplary embodiment, the stabilization contact springs 646 define multiple points of contact with the power terminal 400 and multiple points of contact with the header tab terminal 122. An electrical connection is made between the crimp terminal 410 and the header tab terminal 122 through the spring clip 600.

Figure 21:
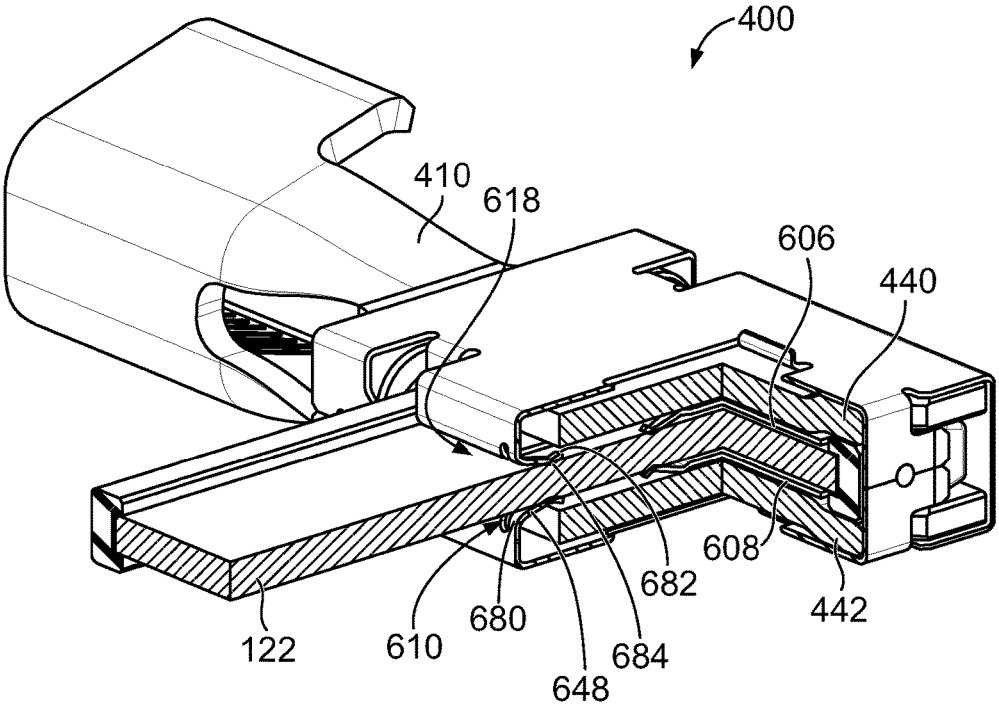
FIG. 21 is a partial sectional view of the power terminal shown in FIG. 15.
Figure 22:
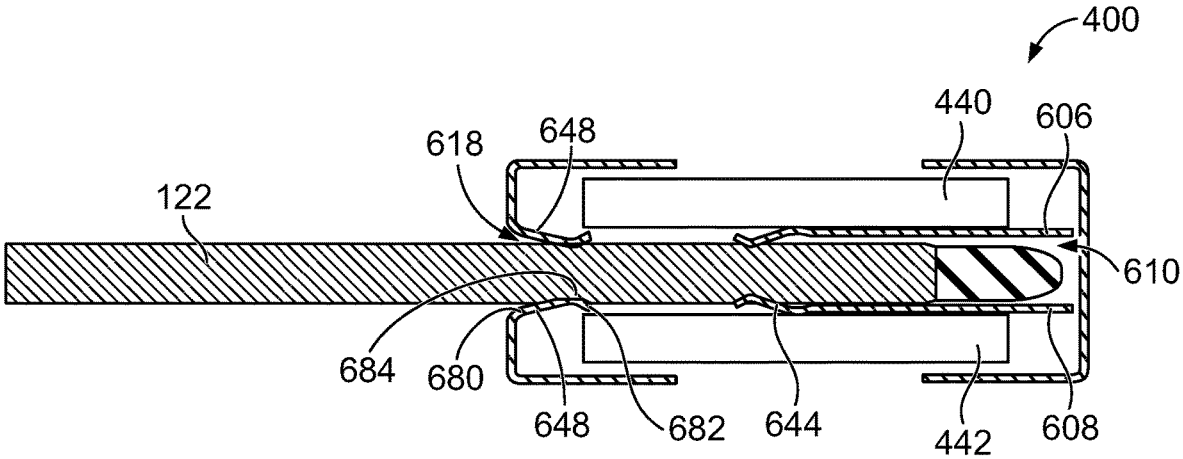
FIG. 22 is a cross sectional view of the power terminal shown in FIG. 15.

FIG. 21 is a partial sectional view of the right angle crimp power terminal 400 mated to the header tab terminal 122. FIG. 22 is a cross sectional view of the right angle crimp power terminal 400 mated to the header tab terminal 122. FIGS. 21 and 22 illustrate the forward contact springs 648 spring biased against and electrically connected to the header tab terminal 122 and the plates 440, 442 of the crimp terminal 410. The forward contact springs 648 are aligned with corresponding cantilevered contact springs 644. The forward contact springs 648 may be similar to the cantilevered contact springs 648; however, the forward contact springs 648 may be located forward of other cantilevered contact springs 644, such as at or near the opening 618 to the slot 610.

The forward contact springs 648 include fixed ends 680 extending from the corresponding inner spring plates 606, 608 and free ends 682 configured to be resiliently deflected against the header tab terminal 122 when the header tab terminal 122 is received in the slot 610. In an exemplary embodiment, the free ends 682 are curved and define bumps configured to engage the header tab terminal 122. The bumps define contact interfaces 684 with the header tab terminal 122.

Figure 23:
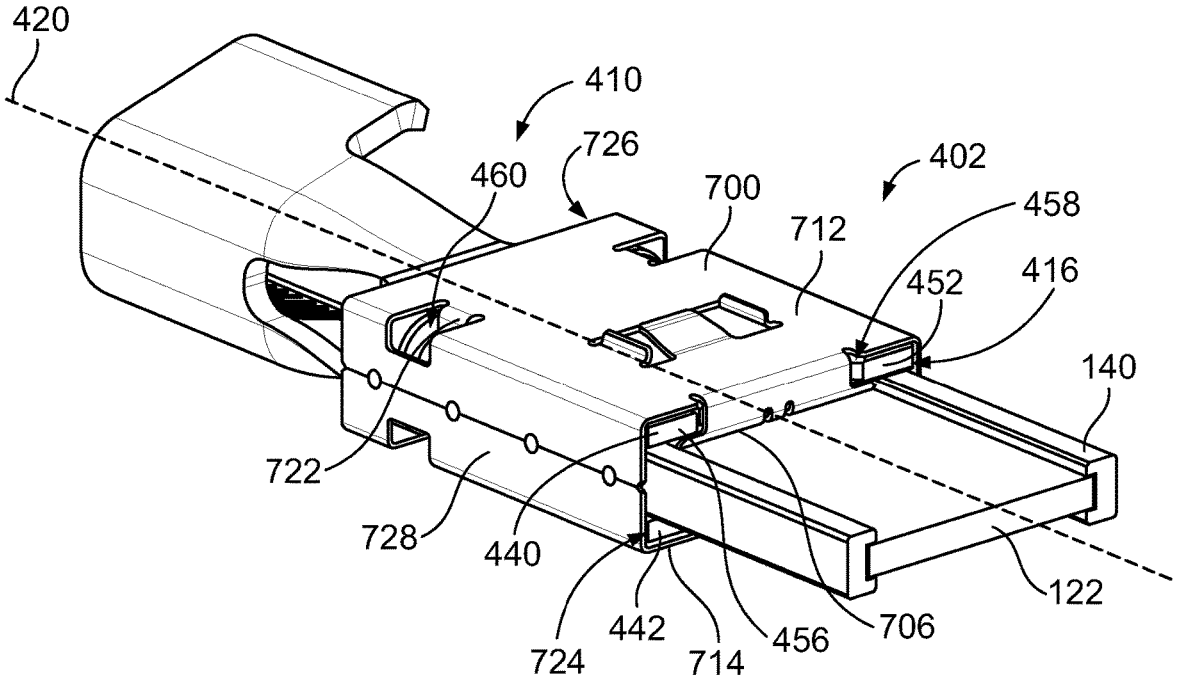
FIG. 23 illustrates one of the power terminals terminated to the header tab terminal.

FIG. 23 illustrates the in-line crimp power terminal 402 terminated to the corresponding header tab terminal 122. The in-line crimp power terminal 402 is mated to the header tab terminal 122 in a mating direction that is parallel to the longitudinal axis 420. The in-line spring clip 700 receives the header tab terminal 122 in a mating direction parallel to the longitudinal axis 420. The in-line weld tab terminal 406 (shown in FIG. 10) may receive the in-line spring clip 700 in a similar manner as described herein.

The right angle spring clip 700 is coupled to the crimp terminal 410. For example, the spring clip 700 may be loaded onto the mating portion 416 through a loading end 726 of the spring clip 700. The first and second plates 440, 442 may be positioned between the inner spring plates 706, 708 and the first and second sides 712, 714, respectively. As such, the inner spring plates 706, 708 wrap around the plates 440, 442 of the mating portion 416 of the crimp terminal 410. The power terminal latches 722 may be bent into place after the spring clip 700 is coupled to the mating portion 416. For example, the power terminal latches 722 may be bent into corresponding pockets 460. When the spring clip 700 is coupled to the crimp terminal 410, an end wall 728 is received in the windows 458 at the outer ends 452 of the plates 440, 442. The flanges 456 may protrude at least partially through the windows 724 in the spring clip 700. In an exemplary embodiment, the flanges 456 of the first and second plates 440, 442 are spaced apart far enough to accommodate the touch safe cover 140 on the header tab terminal 122.

Figure 24:
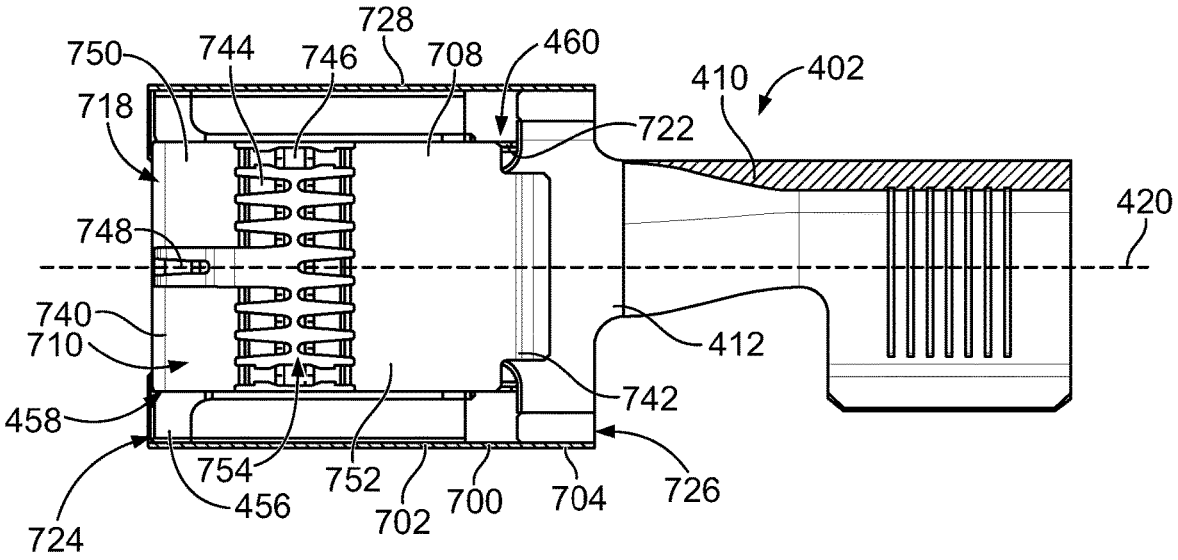
FIG. 24 is a cross-sectional view of the power terminal shown in FIG. 23.
Figure 25:
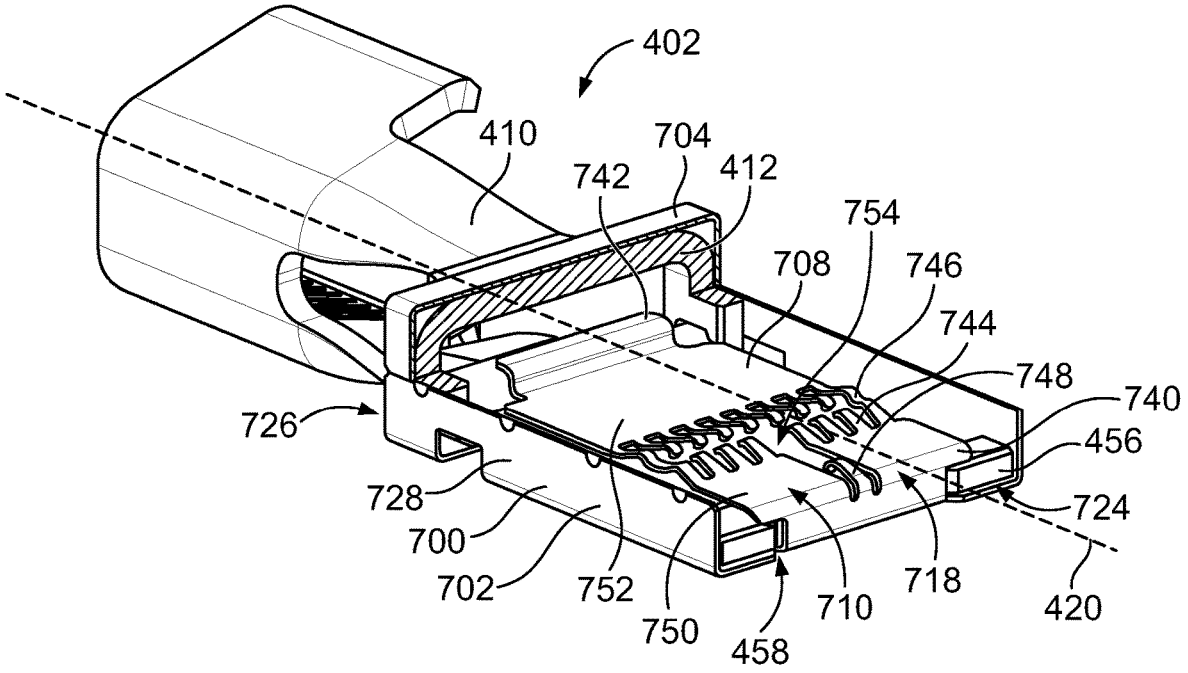
FIG. 25 is a partial sectional view of the in-line crimp power terminal.

FIG. 24 is a cross-sectional view of the in-line crimp power terminal 402 showing the right angle spring clip 700 coupled to the crimp terminal 410. FIG. 25 is a partial sectional view of the in-line crimp power terminal 402. FIGS. 24 and 25 illustrates the inner spring plate 708; however, it is realized that the inner spring plate 706 (shown in FIG. 23) may include similar or identical features as the inner spring plate 708. The walls of the spring clip body 702 wrap snugly around the crimp terminal 410 to position the spring clip 700 on the crimp terminal 410. For example, the power terminal latches 722 are received in corresponding pockets 460. The end wall 728 is received in the corresponding window 458. The flanges 456 are received in corresponding windows 724.

The inner spring plate 708 extends from a front 740 to a rear 742. The front 740 is generally defined at the opening 718 to the slot 710. The rear 742 may extend to an area at or near the loading end 726 of the outer shell 704 generally opposite the opening 718. In the illustrated embodiment, the spring clip 700 is oriented such that the inner spring plate 708 extends along the crimp terminal 410 (e.g., parallel to the longitudinal axis 420).

The inner spring plate 708 includes a plurality of contact springs that are used to electrically and mechanically engage the header tab terminal and/or the terminal body 412. In an exemplary embodiment, the inner spring plate 708 includes different types of contact springs to provide different functions. For example, the inner spring plate 708 includes one or more cantilevered contact springs 744, one or more stabilization contact springs 746, and one or more forward contact springs 748. The cantilevered contact springs 744 may be substantially similar to the cantilevered contact springs 644 (shown in FIG. 16) and like components may be referred to with like reference numerals. The stabilization contact springs 746 may be substantially similar to the stabilization contact springs 646 (shown in FIG. 16) and like components may be referred to with like reference numerals. The forward contact springs 748 may be substantially similar to the forward contact springs 648 (shown in FIG. 16) and like components may be referred to with like reference numerals.

The cantilevered contact springs 744 provide the main electrical connection to the header tab terminal 122. The stabilization contact springs 746 provide the main mechanical connection with the header tab terminal. The forward contact spring 748 provides the last mated interface between the power terminal 400 and the header tab terminal during unmating to ensure that the HVIL circuit is opened prior to the high power circuit being opened. In the illustrated embodiment, the forward contact spring 748 is the forward most contact spring, closest to the front 740. In the illustrated embodiment, the cantilevered contact springs 744 and the stabilization contact springs 746 are provided at or near a central portion of the inner spring plate 708.

The inner spring plate 708 includes a forward plate portion 750 and a rearward plate portion 752 separated by one or more openings 754. The contact springs 744, 746, 748 may be stamped from the inner spring plate 708 at the one or more opening 754. In an exemplary embodiment, the stabilization contact springs 746 bridge between and connect to both the forward plate portion 750 and the rearward plate portion 752. Optionally, the stabilization contact springs 746 may be the only portions of the inner spring plate 708 spanning between the forward plate portion 750 and the rearward plate portion 752.

In an exemplary embodiment, the cantilevered contact springs 744 extend only partially across the opening 754. For example, in the illustrated embodiment, the inner spring plate 708 includes a plurality of cantilevered contact springs 744 extending from the forward plate portion 750 and a plurality of cantilevered contact springs 744 extending from the rearward plate portion 752. Optionally, such cantilevered contact springs 744 may oppose each other across the opening 754.

Any number of contact springs may be provided. In the illustrated embodiment, the inner spring plate 708 includes a pair of stabilizing contact springs 746 flanking a plurality of the cantilevered contact springs 744. The stabilization contact springs 746 are provided as the outer most contact springs while the cantilevered contact springs 744 are the inner contact springs.

Figure 26:
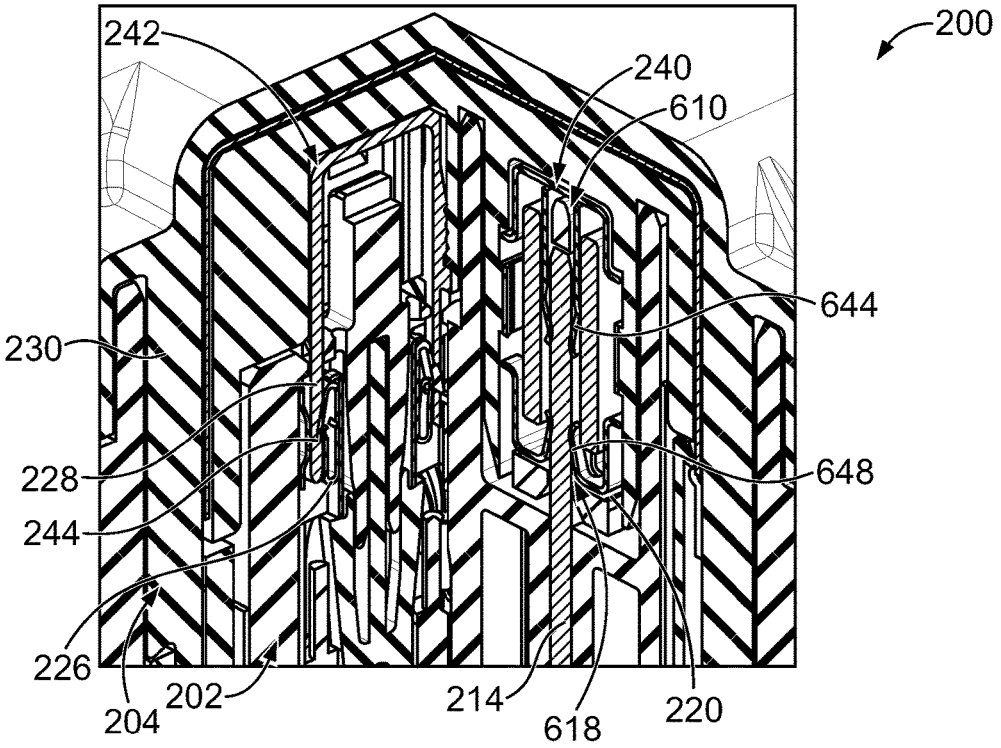
FIG. 26 illustrates the electrical connector and header connector in a mated state.
Figure 27:
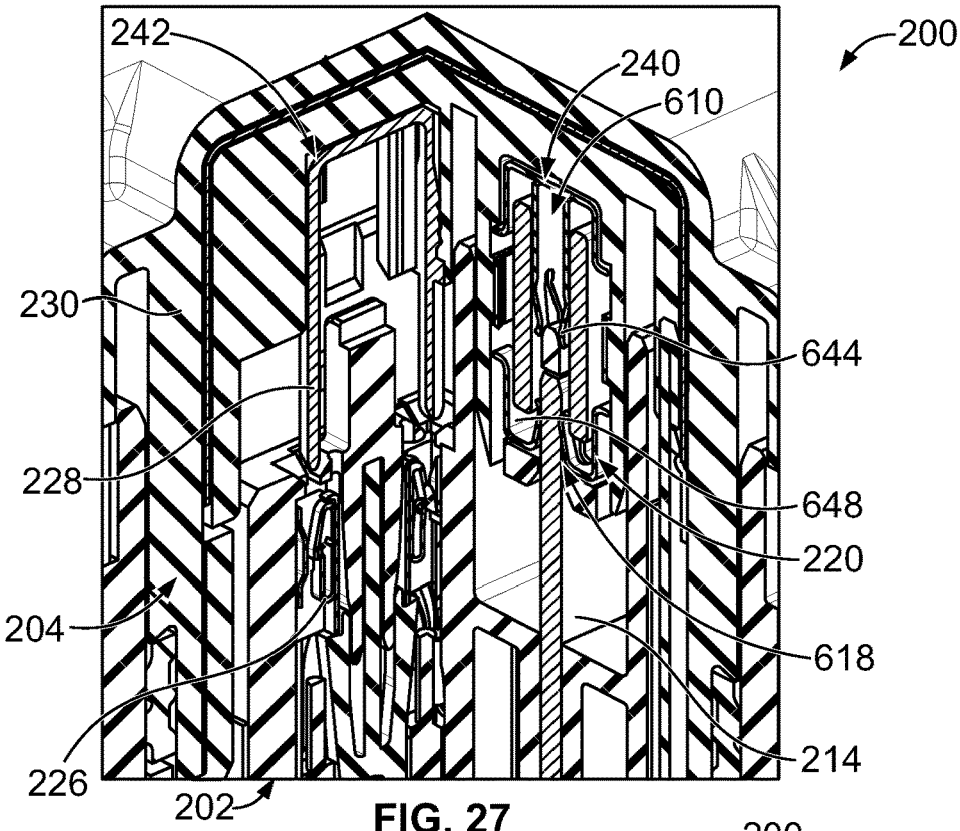
FIG. 27 illustrates the electrical connector and header connector in a partially unmated state.
Figure 28:
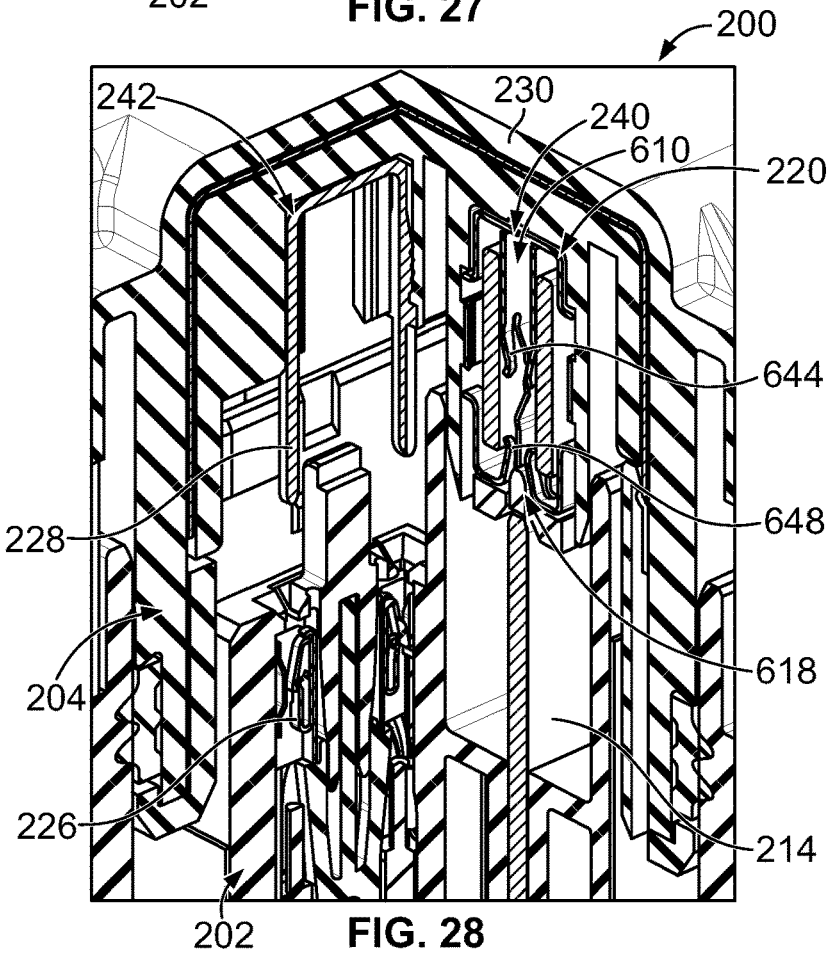
FIG. 28 illustrates the electrical connector and header connector in a partially unmated state.

FIGS. 26-28 illustrate an unmating sequence of the electrical connector 204 from the header connector 202. FIGS. 26-28 illustrate an unmating sequence of the power terminals 220 from the header tab terminals 214 and of the HVIL terminal 228 from the HVIL contacts 226. FIG. 26 illustrates the electrical connector 204 in a mated position. FIG. 27 illustrates the electrical connector 204 in a partially unmated position. FIG. 28 illustrates the electrical connector 204 in a partially unmated position.

The housing 230 of the electrical connector 204 includes a terminal chamber 240 and an HVIL terminal chamber 242. The HVIL terminal 228 is received in the terminal chamber 240. The HVIL terminal 228 has a mating interface 244 configured to be mated to and unmated from the HVIL contact 226 to control the high voltage circuit of the electrical connector 204. The power terminal 230 is received in the terminal chamber 240 and is configured for electrical connection with the header tab terminal 214 when the electrical connector 204 is mated with the header connector 202.

When mated (FIG. 26), the HVIL circuit and the high voltage circuit are both closed and thus the high voltage circuit is operational. During unmating, the HVIL circuit is initially opened (FIG. 27), such as by partially unmating the electrical connector 204 from the header connector 202. The HVIL terminal 228 of the electrical connector 204 is unmated from the HVIL contacts 226 of the header connector 202. When the HVIL circuit is opened (FIG. 27), the system 200 will shut off the high voltage circuit to cease power flow through the power terminal 220 and the header tab terminal 214. However, to prevent damage, such as from arcing, the power terminal 220 is still mated with the header tab terminal 214 even when the HVIL circuit is initially opened (FIG. 27). For example, as shown in FIG. 27, the forward contact springs 648, which are the forward-most contact springs (e.g., the contact springs closest to the opening 618 to the slot 610), maintain electrical contact with the header tab terminal 214 after the HVIL circuit is opened. Further unmating (FIG. 28) completely unmates the power terminal 220 from the header tab terminal 214. The forward contact springs 648 are configured to be unmated from the header tab terminal 214 after the cantilevered contact springs 644 are unmated from the header tab terminal 214 when the electrical connector 204 is unmated from the header connector 202.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A power terminal for a high power electrical connector, the power terminal comprising:

a terminal body having a terminating portion, a mating portion and a base between the terminating portion and the mating portion, the terminating portion being configured to be terminated to a power wire, the mating portion having first and second plates with a mating space therebetween; and a spring clip coupled to the mating portion of the terminal body, the spring clip having an outer shell extending along an exterior of the first and second plates and first and second inner spring plates extending along the first and second plates, respectively, in the mating space, a slot being defined between the first and second inner spring plates configured to receive a tab terminal, the first and second inner spring plates configured to directly engage and electrically connect the mating portion of the terminal body and the tab terminal;

wherein the spring clip includes at least one cantilevered contact spring configured to be spring biased against and electrically connected to the tab terminal, and wherein the spring clip includes at least one stabilization contact spring spring biased against and electrically connected to at least one of the first plate or the second plate and configured to be spring biased against and electrically connected to the tab terminal, the stabilization contact spring providing a greater contact normal force against the tab terminal than the cantilevered contact spring.

2. The power terminal of claim 1, wherein the cantilevered contact spring includes a fixed end extending from the corresponding first or second inner spring plate and a free end configured to be resiliently deflected against the tab terminal when the tab terminal is received in the slot.

3. The power terminal of claim 1, wherein the stabilization contact spring includes a first fixed end extending from the corresponding first or second inner spring plate and a second fixed end extending from the corresponding first or second inner spring plate, the stabilization contact spring having a contact interface between the first and second fixed ends configured to engage the tab terminal.

4. The power terminal of claim 3, wherein the stabilization contact spring includes a plurality of the contact interfaces between the first and second fixed ends configured to engage the tab terminal.

5. The power terminal of claim 3, wherein the stabilization contact spring includes at least one contact interface between the first and second fixed ends engaging the corresponding first plate or second plate of the mating portion of the terminal body.

6. The power terminal of claim 1, wherein the first inner spring plate includes a forward plate portion and a rearward plate portion separated by an opening, the spring clip including a plurality of the cantilevered contact springs extending from the forward plate portion partially across the opening and the spring clip includes a plurality of the cantilevered contact springs extending from the rear plate portion partially across the opening, the stabilization contact spring bridging between and connected to both the front plate portion and the rear plate portion.

7. The power terminal of claim 1, wherein the spring clip includes a plurality of cantilevered contact springs and a pair of stabilization contact springs flanking the plurality of cantilevered contact springs.

8. The power terminal of claim 1, wherein the terminating portion includes a weld pad configured to be welded to the power wire.

9. The power terminal of claim 1, wherein the terminating portion includes a crimp barrel configured to be crimped to the power wire.

10. The power terminal of claim 1, wherein the first and second plates extend from the base along a longitudinal axis of the terminal body, the spring clip configured to be coupled to the mating portion in a first orientation such that the slot receives the tab terminal along a mating axis perpendicular to the longitudinal axis, the spring clip being configured to be coupled to the mating portion in a second orientation such that the slot receives the tab terminal along a mating axis parallel to the longitudinal axis.

11. The power terminal of claim 1, wherein the spring clip comprises a first spring clip, the slot, cantilevered contact spring and stabilization contact spring being oriented perpendicular to the first and second plates, the power terminal further comprising a second spring clip having a slot configured to receive a tab terminal and at least one cantilevered contact spring and at least one stabilization contact spring being oriented parallel to the first and second plates, wherein either the first spring clip or the second spring clip is selectively coupled to the mating portion of the terminal body to selectively change a mating orientation of the tab terminal with respect to the mating portion from a right angle mating orientation to an inline mating orientation, respectively.

12. The power terminal of claim 1, wherein the spring clip includes at least one forward contact spring offset from the at least one cantilevered contact spring toward the front of the slot, the forward contact spring configured to be spring biased against and electrically connected to the header tab terminal, the forward contact spring being configured to be unmated from the header tab terminal after the cantilevered contact spring is unmated from the header tab terminal when the electrical connector is unmated from the header connector.

13. An electrical connector for mating with and unmating from a high power header connector having a header tab terminal and a high voltage interlock (HVIL) contact, the electrical connector comprising:

a housing having a terminal chamber and an HVIL terminal chamber;

a HVIL terminal received in the terminal chamber, the HVIL terminal having a mating interface configured to be mated to and unmated from the HVIL contact to control a high voltage circuit of the electrical connector; and a power terminal received in the terminal chamber and configured for electrical connection with the header tab terminal when the electrical connector is mated with the header connector, the power terminal comprising:

a terminal body having a terminating portion, a mating portion and a base between the terminating portion and the mating portion, the terminating portion being configured to be terminated to a power wire, the mating portion having first and second plates with a mating space therebetween; and a spring clip coupled to the mating portion of the terminal body, the spring clip having an outer shell extending along an exterior of the first and second plates and first and second inner spring plates extending along the first and second plates, respectively, in the mating space, a slot defined between the first and second inner spring plates and extending between a front and a rear, the slot configured to receive the header tab terminal through the front of the slot, the first and second inner spring plates configured to directly engage and electrically connect the mating portion of the terminal body and the header tab terminal;

wherein the spring clip includes at least one cantilevered contact spring configured to be spring biased against and electrically connected to the header tab terminal, the at least one cantilevered contact spring being located remote from the front of the slot, and wherein the spring clip includes at least one forward contact spring offset from the at least one cantilevered contact spring, the forward contact spring being provided at the front of the slot, the forward contact spring configured to be spring biased against and electrically connected to the header tab terminal, the forward contact spring being configured to be unmated from the header tab terminal after the cantilevered contact spring is unmated from the header tab terminal when the electrical connector is unmated from the header connector.

14. The electrical connector of claim 13, wherein the spring clip includes at least one stabilization contact spring spring biased against and electrically connected to at least one of the first plate or the second plate and configured to be spring biased against and electrically connected to the tab terminal, the stabilization contact spring providing a greater contact normal force against the tab terminal than the cantilevered contact spring.

15. The electrical connector of claim 14, wherein the stabilization contact spring includes a first fixed end extending from the corresponding first or second inner spring plate and a second fixed end extending from the corresponding first or second inner spring plate, the stabilization contact spring having a contact interface between the first and second fixed ends configured to engage the tab terminal.

16. The electrical connector of claim 13, wherein the cantilevered contact spring includes a fixed end extending from the corresponding first or second inner spring plate and a free end configured to be resiliently deflected against the tab terminal when the tab terminal is received in the slot.

17. The electrical connector of claim 13, wherein the terminating portion includes a weld pad configured to be welded to the power wire.

18. The electrical connector of claim 13, wherein the terminating portion includes a crimp barrel configured to be crimped to the power wire.

19. The electrical connector of claim 13, wherein the first and second plates extend from the base along a longitudinal axis of the terminal body, the spring clip configured to be coupled to the mating portion in a first orientation such that the slot receives the tab terminal along a mating axis perpendicular to the longitudinal axis, the spring clip being configured to be coupled to the mating portion in a second orientation such that the slot receives the tab terminal along a mating axis parallel to the longitudinal axis.

20. The power terminal of claim 13, wherein the spring clip comprises a first spring clip, the slot and cantilevered contact spring being oriented perpendicular to the first and second plates, the power terminal further comprising a second spring clip having a slot configured to receive a tab terminal and at least one cantilevered contact spring being oriented parallel to the first and second plates, wherein either the first spring clip or the second spring clip is selectively coupled to the mating portion of the terminal body to selectively change a mating orientation of the tab terminal with respect to the mating portion from a right angle mating orientation to an inline mating orientation, respectively.

21. An electrical connector system comprising:

a header connector having a header housing holding a header tab terminal, the header tab terminal being oriented for mating in a mating direction along a mating axis; and a family of electrical connectors configured to be terminated to a high power wire and configured for mating with the header connector and the header tab terminal in the mating direction, each of the family of electrical connectors comprising a housing, a power terminal and a spring clip coupled to the power terminal, the spring clip including at least one cantilevered contact spring configured to be spring biased against and electrically connected to the tab terminal and the spring clip including at least one stabilization contact spring configured to be spring biased against and electrically connected to the tab terminal, the stabilization contact spring providing a greater contact normal force against the tab terminal than the cantilevered contact spring, the housing being one of a right angle housing or an in-line housing, the power terminal being one of a crimp terminal or a weld tab terminal, the spring clip being one of a right-angle spring clip or an in-line spring clip, the housings, power terminals and spring clips being combined in one of a first arrangement, a second arrangement, a third arrangement or a fourth arrangement;

wherein, in the first arrangement, a crimp barrel of the crimp terminal is crimped to the high power wire and the right angle spring clip is coupled to a mating portion of the crimp terminal, the crimp terminal and the right angle spring clip being loaded into the right angle housing with the high power wire being arranged perpendicular to the mating direction;

wherein, in the second arrangement, the crimp barrel of the crimp terminal is crimped to the high power wire and the in-line spring clip is coupled to the mating portion of the crimp terminal, the crimp terminal and the in-line spring clip being loaded into the in-line housing with the high power wire being arranged parallel to the mating direction;

wherein, in the third arrangement, a weld tab of the weld tab terminal is welded to the high power wire and the right angle spring clip is coupled to a mating portion of the weld tab terminal, the mating portion of the weld tab terminal being identical to the mating portion of the crimp terminal, the weld tab terminal and the right angle spring clip being loaded into the right angle housing with the high power wire being arranged perpendicular to the mating direction; and wherein, in the fourth arrangement, the weld tab of the weld tab terminal is welded to the high power wire and the in-line spring clip is coupled to the mating portion of the weld tab terminal, the weld tab terminal and the in-line spring clip being loaded into the in-line housing with the high power wire being arranged parallel to the mating direction.

22. The electrical connector system claim 21, wherein the spring clip includes at least one forward contact spring offset from the at least one cantilevered contact spring toward a front of the spring clip, the forward contact spring configured to be spring biased against and electrically connected to the header tab terminal, the forward contact spring being configured to be unmated from the header tab terminal after the cantilevered contact spring is unmated from the header tab terminal when the electrical connector is unmated from the header connector.

* * * * *